US010314758B2

(12) United States Patent
Dolliver et al.

(10) Patent No.: US 10,314,758 B2
(45) Date of Patent: Jun. 11, 2019

(54) PERSON SUPPORT APPARATUS WITH TRACKING FEATURES

(71) Applicant: Allen Medical Systems, Inc., Batesville, IN (US)

(72) Inventors: Phillip B. Dolliver, Batesville, IN (US); Alexander Rojas, Waltham, MA (US); Michael Pierce, Harvard, MA (US)

(73) Assignee: Allen Medical Systems, Inc., Batesville, IN (US)

( * ) Notice: Subject to any disclaimer, the term of this patent is extended or adjusted under 35 U.S.C. 154(b) by 511 days.

(21) Appl. No.: 15/222,596

(22) Filed: Jul. 28, 2016

(65) Prior Publication Data

US 2017/0027797 A1 Feb. 2, 2017

Related U.S. Application Data

(60) Provisional application No. 62/199,974, filed on Jul. 31, 2015.

(51) Int. Cl.
*A61G 13/02* (2006.01)
*A61G 13/08* (2006.01)
(Continued)

(52) U.S. Cl.
CPC ..... *A61G 13/08* (2013.01); *A61G 13/0036* (2013.01); *A61G 13/04* (2013.01);
(Continued)

(58) Field of Classification Search
CPC ..... A61G 13/02
(Continued)

(56) References Cited

U.S. PATENT DOCUMENTS 4,944,056 A 7/1990 Schroeder et al.
6,289,534 B1 9/2001 Hakamiun et al.
(Continued)

FOREIGN PATENT DOCUMENTS

EP 2684549 A2 1/2014
EP 2727571 A2 7/2014
(Continued)

OTHER PUBLICATIONS

Unirope Ltd; RFID Tags; [retrieved online on Jul. 11, 2013], http://www.unirope.com/chainmeshslings/rfid_tags.shtml. pp. 1-2.
(Continued)

*Primary Examiner* — Fredrick C Conley
(74) *Attorney, Agent, or Firm* — Dinsmore & Shohl LLP

(57) ABSTRACT

Systems and processes of controlling a function of a person support apparatus are provided. An example system includes a person support apparatus adapted to support a patient. The person support apparatus comprising a controller adapted to communicatively couple with at least one removable component of the person support apparatus. The controller is adapted to determine the absence or presence of the at least one removable component. In response to the determination, the controller is further adapted to disable at least one movement of the person support apparatus in response to a determination that the at least one removable component is not present or enable the at least one movement in response to a determination that the at least one removable component is present.

24 Claims, 16 Drawing Sheets

(51) Int. Cl.

| | |
|---|---|
| ***A61G 13/04*** | (2006.01) |
| ***A61G 13/06*** | (2006.01) |
| ***A61G 13/12*** | (2006.01) |
| ***A61G 13/00*** | (2006.01) |
| ***A61G 13/10*** | (2006.01) |

(52) U.S. Cl.
CPC ..... *A61G 13/06* (2013.01); *A61G 13/104* (2013.01); *A61G 13/121* (2013.01); *A61G 13/122* (2013.01); *A61G 13/1235* (2013.01); *A61G 13/1245* (2013.01); *A61G 13/1285* (2013.01); *A61G 13/1295* (2013.01); *A61G 2203/40* (2013.01)

(58) Field of Classification Search
USPC ..... 5/600–601, 613–618; 700/237, 243, 275
See application file for complete search history.

(56) References Cited

U.S. PATENT DOCUMENTS

| | | | | |
|---|---|---|---|---|
| 6,523,195 | B1 | 2/2003 | Rodier et al. | |
| 6,566,833 | B2 * | 5/2003 | Bartlett | A61G 7/001 318/564 |
| 7,240,621 | B2 | 7/2007 | Chepurny et al. | |
| 8,538,710 | B2 | 9/2013 | Todd et al. | |
| 8,910,325 | B2 | 12/2014 | Faucher et al. | |
| 2002/0138905 | A1 | 10/2002 | Bartlett et al. | |
| 2009/0049610 | A1 | 2/2009 | Heimbrock et al. | |
| 2009/0307840 | A1 | 12/2009 | Lingegard | |
| 2010/0001838 | A1 | 1/2010 | Miodownik et al. | |
| 2010/0097181 | A1 | 4/2010 | Sorensen et al. | |
| 2010/0192296 | A1 | 8/2010 | Clough | |
| 2010/0217618 | A1 | 8/2010 | Piccirillo et al. | |
| 2010/0224841 | A1 | 9/2010 | Liljedahl | |
| 2011/0035058 | A1 | 2/2011 | Clough | |
| 2011/0301440 | A1 | 12/2011 | Riley et al. | |
| 2012/0095777 | A1 | 4/2012 | Chang et al. | |
| 2013/0019401 | A1 | 1/2013 | Faucher et al. | |
| 2013/0076517 | A1 | 3/2013 | Penninger et al. | |
| 2013/0091631 | A1 | 4/2013 | Hayes et al. | |
| 2013/0205501 | A1 | 8/2013 | Robertson et al. | |
| 2013/0253291 | A1 | 9/2013 | Dixon et al. | |
| 2013/0319775 | A1 | 12/2013 | Ngoh et al. | |
| 2014/0013503 | A1 | 1/2014 | Dixon et al. | |
| 2014/0020175 | A1 | 1/2014 | Dixon et al. | |
| 2014/0080413 | A1 * | 3/2014 | Hayes | H04B 5/0037 455/41.1 |
| 2014/0115778 | A1 | 5/2014 | Ng | |
| 2017/0027794 | A1 | 2/2017 | Andersson et al. | |
| 2017/0027797 | A1 | 2/2017 | Dolliver et al. | |

FOREIGN PATENT DOCUMENTS

| | | | |
|---|---|---|---|
| WO | 2007075701 | A2 | 7/2007 |
| WO | 2010141865 | A1 | 12/2010 |
| WO | 2015024569 | A1 | 2/2015 |

OTHER PUBLICATIONS

LiftAll; RFID Tagging; [online], www.lift-all.com; (Nov. 2009). p. 1.

Extended European Search Report & Written Opinion dated Feb. 27, 2015 relating to EP Patent Application No. 13176406.0. pp. 1-12.

Non-Final Office Action dated Jun. 12, 2014 relating to U.S. Appl. No. 13/941,161, filed Jul. 12, 2013. pp. 1-10.

Non-Final Office Action dated Feb. 9, 2015 relating to U.S. Appl. No. 13/941,161, filed Jul. 12, 2013. pp. 1-11.

Non-Final Office Action dated Dec. 3, 2015 relating to U.S. Appl. No. 13/941,161, filed Jul. 12, 2013. pp. 1-13.

Non-Final Office Action dated Sep. 10, 2015 relating to U.S. Appl. No. 13/941,179, filed Jul. 12, 2013. pp. 1-9.

Non-Final Office Action dated Nov. 17, 2016 relating to U.S. Appl. No. 13/941,161, filed Jul. 12, 2013. pp. 1-16.

Final Office Action dated Sep. 19, 2016 relating to U.S. Appl. No. 13/941,161, filed Jul. 12, 2013. pp. 1-15.

Non-Final Office Action dated May 16, 2016 relating to U.S. Appl. No. 13/941,161, filed Jul. 12, 2013. pp. 1-13.

Final Office Action dated Apr. 12, 2016 relating to U.S. Appl. No. 13/941,179, filed Jul. 12, 2013. pp. 1-9.

Non-Final Office Action dated Aug. 3, 2016 relating to U.S. Appl. No. 13/941,179, filed Jul. 12, 2013. pp. 1-10.

Final Office Action dated Jan. 30, 2017 relating to U.S. Appl. No. 13/941,179, filed Jul. 12, 2013. pp. 1-11.

Letter dated Sep. 15, 2014 from Ari M. Bai with Poisinelli; One East Street, Syuite 1200; Phoenix, AZ 85004-2568 Re: U.S. Appl. No. 13/941,161 Monitoring Systems Devices and Methods for Patient Lift. Refers to U.S. Pat. No. 8,538,710 and U.S. Publication No. 2014/0013503.

Claim Chart for U.S. Patent Application Publication No. 2014/0013503 ('503 Application), Dixon et al. Monitoring Systems Devices and Methods for Patient Lift. Refers to U.S. Pat. No. 8,538,710 (the '710 Patent) Todd et al. Methods and Systems for Monitoring Lift Usage.

Extended European Search Report dated Nov. 14, 2016 relating to EP Patent Application No. 16176711.6. pp. 1-12.

Extended European Search Report dated Dec. 12, 2016 relating to EP Patent Application No. 16181917.2. pp. 1-7.

* cited by examiner

PERSON SUPPORT APPARATUS WITH TRACKING FEATURES

BACKGROUND

Field

The present specification generally relates to systems and processes for tracking accessories and/or functions of a person support apparatus and enabling and/or disabling user functions for the apparatus.

Technical Background

In various surgical and diagnostic procedures, person support apparatuses, such as operating tables, may be configured to use different accessories and/or functionalities depending on the procedures. Depending on the functionalities being used, it might be harmful to a patient or to the surgical equipment if the support apparatus is not set up in a proper manner. Where a support apparatus is rotated or elevated to position a patient for a particular procedure, restraints may need to be attached to the apparatus and secured to keep the patient in place on the operating table.

Accordingly, a need exists for determining whether accessories of a person support apparatus, such as an operating table, are configured properly before enabling one or more functionalities of the apparatus.

SUMMARY

Systems and processes of controlling a function of a person support apparatus are provided. In one embodiment, a system includes a person support apparatus adapted to support a patient. The person support apparatus comprising a controller adapted to communicatively couple with at least one removable component of the person support apparatus. The controller is adapted to determine the absence or presence of the at least one removable component. In response to the determination, the controller is further adapted to disable at least one movement of the person support apparatus in response to a determination that the at least one removable component is not present or enable the at least one movement in response to a determination that the at least one removable component is present.

In another embodiment, a process of enabling or disabling at least one movement of a person support apparatus is provided. In this embodiment, the process includes: using a processor adapted to communicate with at least one removable component of a person support apparatus; determining the presence or absence of the at least one removable component of the person support apparatus; in response to a determination that the at least one removable component is not present, disabling at least one movement of the person support apparatus or in response to a determination that the at least one removable component is present enabling the at least one movement.

Additional features and advantages of the embodiments described herein will be set forth in the detailed description which follows, and in part will be readily apparent to those skilled in the art from that description or recognized by practicing the embodiments described herein, including the detailed description which follows, the claims, as well as the appended drawings.

It is to be understood that both the foregoing general description and the following detailed description describe various embodiments and are intended to provide an overview or framework for understanding the nature and character of the claimed subject matter. The accompanying drawings are included to provide a further understanding of the various embodiments, and are incorporated into and constitute a part of this specification. The drawings illustrate the various embodiments described herein, and together with the description serve to explain the principles and operations of the claimed subject matter.

DETAILED DESCRIPTION

Systems and processes of controlling a function of a person support apparatus are provided. An example system includes a person support apparatus adapted to support a patient. The person support apparatus comprising a controller adapted to communicatively couple with at least one removable component of the person support apparatus. The controller is adapted to determine the absence or presence of the at least one removable component. In response to the determination, the controller is further adapted to disable at least one movement of the person support apparatus in response to a determination that the at least one removable component is not present or enable the at least one movement in response to a determination that the at least one removable component is present.

Figure 1A:
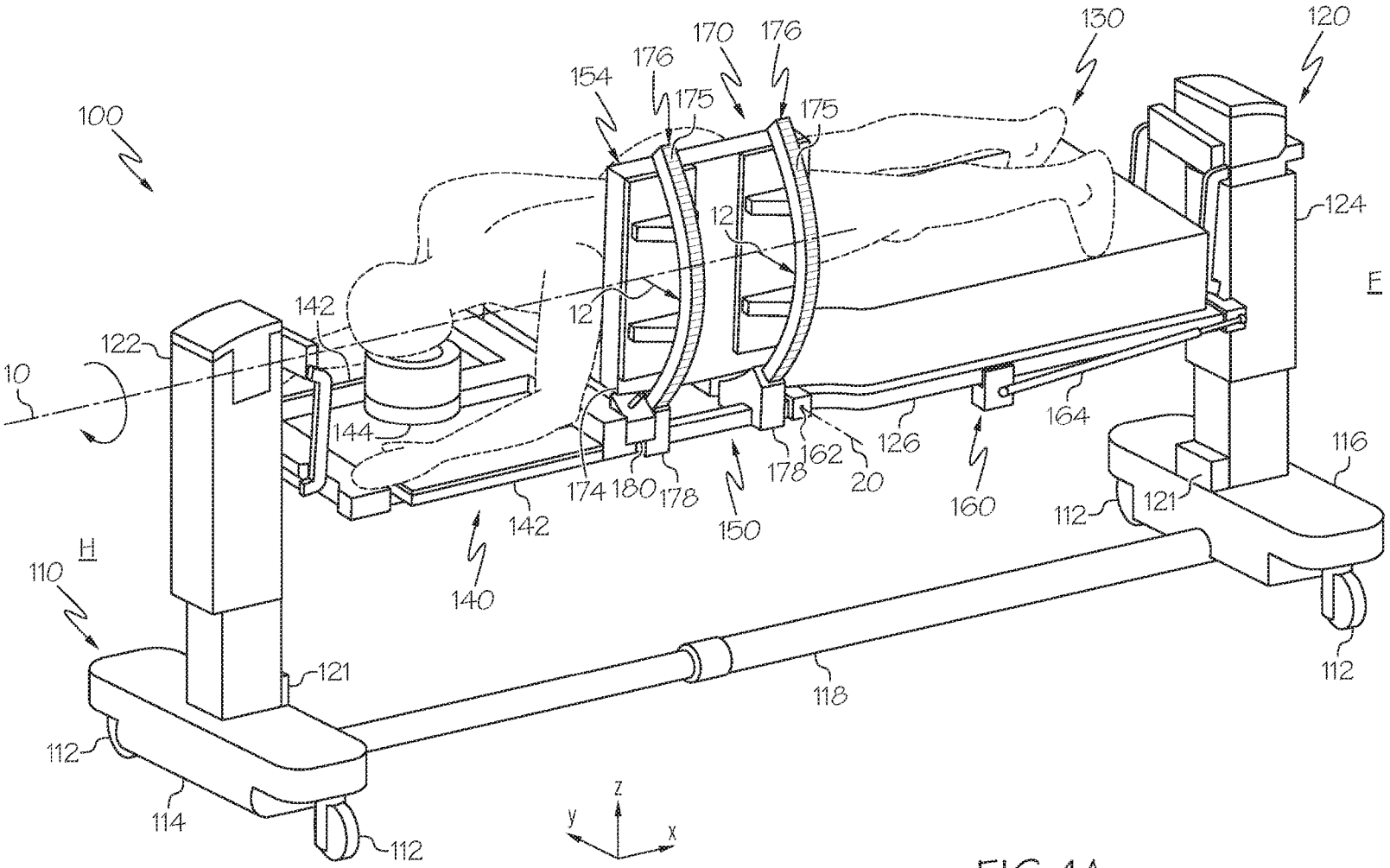
FIG. 1A schematically depicts a perspective view of a person support apparatus including a person repositioning assembly according to one or more embodiments shown or described herein.

Example implementations of person support apparatuses are illustrated in FIGS. 1A through 4 of the accompanying drawings. The person support apparatuses may be used, for example, in conjunction with the methods and systems for determining whether one or more accessories of the person support apparatus are attached and/or configured properly and enabling or disabling one or more functionalities of the apparatus based on the determination described herein. The same reference numerals are generally used throughout the drawings to refer to the same or like parts. One embodiment of a person support apparatus is depicted in FIG. 1A, in which the person support apparatus includes a base frame and a primary support frame supported on the base frame, where the primary support frame extends in a longitudinal direction. The person support apparatus further includes a support deck coupled to the primary support frame, the support deck including an upper segment positioned at a head end of the person support apparatus, a leg segment positioned at a foot end of the person support apparatus, and a torso segment positioned between the upper segment and the leg segment in the longitudinal direction. At least one of the upper segment, the torso segment, and the leg segment rotates with respect to the primary support frame about an axis that extends in the longitudinal direction to reposition a patient positioned on the person support apparatus. Person support apparatuses with repositioning assemblies will be described in more detail herein with specific reference to the appended drawings.

As used herein, the term "longitudinal direction" refers to the forward-rearward direction of the person support apparatus (i.e., in the +/−X-direction as depicted). The term "lateral direction" refers to the cross-direction of the person support apparatus (i.e., in the +/−Y-direction as depicted), and is transverse to the longitudinal direction. The term "vertical direction" refers to the upward-downward direction of the person support apparatus (i.e., in the +/−Z-direction as depicted), and is transverse to the lateral and the longitudinal directions. The terms "head end" and "foot end" refer to the relative location of components of the person support apparatus in the longitudinal direction.

The phrase "communicatively coupled" is used herein to describe the interconnectivity of various components of steering system and means that the components are connected either through wires, optical fibers, or wirelessly such that electrical, optical, and/or electromagnetic signals may be exchanged between the components.

Referring to FIG. 1A, a person support apparatus 100 is depicted. The person support apparatus 100 may include, for example, a two-column operating table with one or more patient restraints. In this particular implementation, the person support apparatus 100 generally includes a base frame 110, a primary support frame 120 that is supported by the base frame 110, and a support deck 130 coupled to the primary support frame 120.

The base frame 110 of the person support apparatus 100 includes a forward portion 114 positioned at a head end of the person support apparatus 100 and a rearward portion 116 positioned at a foot end of the person support apparatus 100. The forward portion 114 and the rearward portion 116 are spaced apart from one another in the longitudinal direction and may be coupled to one another by a central portion 118 that extends between the forward portion 114 and the rearward portion 116 in the longitudinal direction. The central portion 118 may extendable and/or retractable in the longitudinal direction, thereby increasing or decreasing the distance between the forward portion 114 and the rearward portion 116 in the longitudinal direction. In embodiments, the forward portion 114 and the rearward portion 116 are coupled to a plurality of rollers 112, such that the person support apparatus 100 may be moved along a surface, such as a floor.

The primary support frame 120 extends upward from the base frame 110 of the person support apparatus 100. In the embodiment depicted in FIG. 1A, the primary support frame 120 includes a forward column 122 that extends upward from the forward portion 114 of the base frame 110 in the vertical direction. The primary support frame 120 further includes a rearward column 124 that extends upward from the rearward portion 116 of the base frame 110 in the vertical direction. The forward column 122 is positioned at the head end of the person support apparatus 100 and the rearward column 124 is positioned at the foot end of the person support apparatus 100, and the forward column 122 is spaced apart from the rearward column 124 in the longitudinal direction. In embodiments, the forward column 122 and the rearward column 124 are coupled to the forward portion 114 and the rearward portion 116 of the base frame 110, respectively. Alternatively, the forward column 122 and the rearward column 124 may be integral with the forward portion 114 and the rearward portion 116 of the base frame 110, respectively.

The primary support frame 120 includes a longitudinal frame 126 that is positioned above the base frame 110 in the vertical direction and that extends between the forward column 122 and the rearward column 124 in the longitudinal direction. In the embodiment depicted in FIG. 1A, the longitudinal frame 126 generally extends in the horizontal plane (i.e., the X-Y plane as depicted). In other embodiments, the longitudinal frame 126 may be contoured and may include portions that extend out of the horizontal plane. The longitudinal frame 126 supports and may be coupled to the support deck 130, which extends between the forward column 122 and the rearward column 124 in the longitudinal direction.

The forward column 122 and the rearward column 124 may be adjustable in the vertical direction such that the forward column 122 and the rearward column 124 may raise or lower the longitudinal frame 126 with respect to the base frame 110 in the vertical direction. In embodiments, at least one column actuator 121 coupled to the forward column 122 and/or the rearward column 124 and moves the forward column 122 and the rearward column 124 upward and downward in the vertical direction with respect to the base frame 110. The column actuator 121 may be a powered actuator, such as an electric motor or the like, or may be a manually powered, such as by a footpedal, a crank, or the like. The column actuator 121 include a linear actuator, such as a screw, a wheel and axle, a cam, a hydraulic actuator, a pneumatic actuator, a pezioelectric actuator, an electromechanical actuator, or the like.

Figure 4:
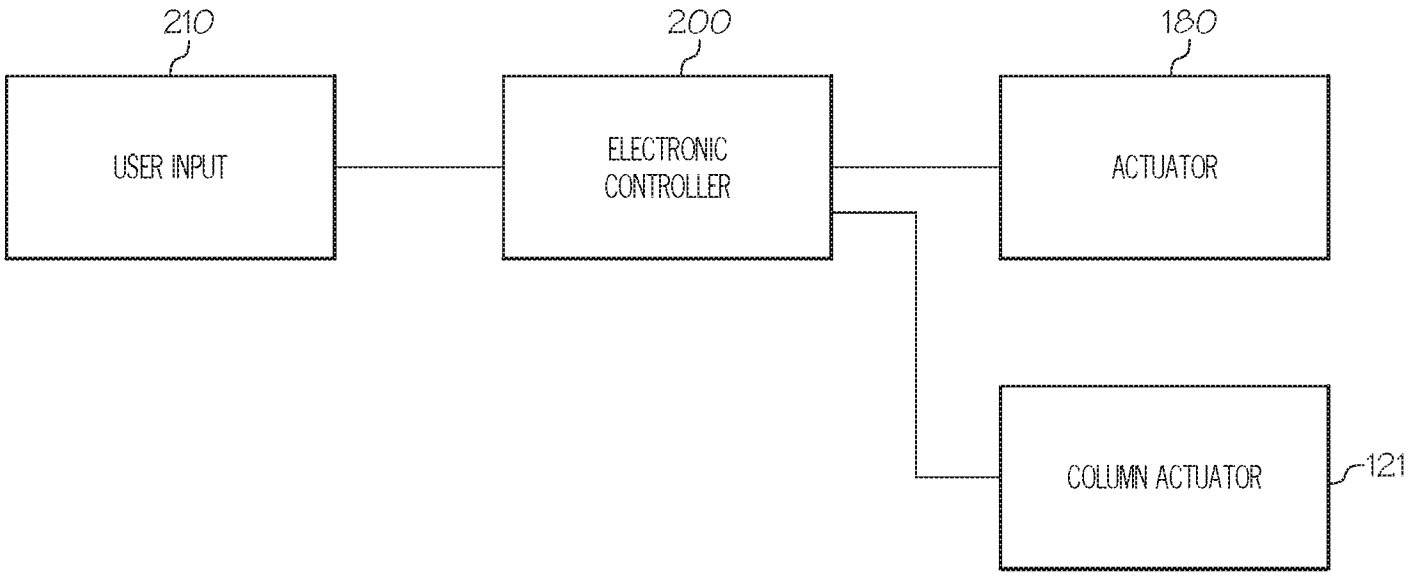
FIG. 4 schematically depicts a block diagram of a control system for the person support apparatus of FIG. 1A according to one or more embodiments shown or described herein.

Referring to FIG. 4, in embodiments where the column actuator 121 includes an electric motor, the column actuator 121 may be communicatively coupled to an electronic controller 200. The electronic controller 200 includes a processor and a memory storing computer readable and executable instructions, which, when executed by the processor, facilitate operation of the column actuator 121. In particular, the electronic controller 200 sends a signal to the at least one column actuator 121 to raise or lower the forward column 122 and/or the rearward column 124 in the vertical direction. A user input 210 is communicatively coupled to the electronic controller 200. The user input 210 includes a device that allows a user to input various parameters into the electronic controller 200 to facilitate operation of the person support apparatus 100. For example, a healthcare professional may utilize the user input 210 to send a signal to the electronic controller 200 to command the at least one actuator 121 to raise or lower the forward column 122 and/or the rearward column 124 in the vertical direction. In embodiments, the user input 210 may include various user input devices, including, but not limited to, graphical user interfaces (GUIs), keyboards, pendants, or the like.

Referring again to FIG. 1A, the forward column 122 and the rearward column 124 may be raised and lowered in the vertical direction independent of one another such that the longitudinal frame 126 may be tilted with respect to the horizontal plane (i.e., the X-Y plane as depicted). For example, the forward column 122 may be raised with respect to the rearward column 124 in the vertical direction such that the head end of the longitudinal frame 126 is positioned higher than the foot end of the longitudinal frame 126 in the vertical direction (i.e., a reverse Trendelenburg position). Conversely, the rearward column 124 may be raised with respect to the forward column 122 in the vertical direction, such that the foot end of the longitudinal frame 126 is positioned higher than the head end of the longitudinal frame 126 in the vertical direction (i.e., a Trendelenburg position). In embodiments, both the forward column 122 and the rearward column 124 of the primary support frame 120 may be raised or lowered in the vertical direction simultaneously, thereby raising both the head end and the foot end of the longitudinal frame 126.

The support deck 130 is coupled to the longitudinal frame 126 and includes one or more segments that are positioned between the forward column 122 and the rearward column 124 in the longitudinal direction to support a patient on the person support apparatus 100. In the embodiment depicted in FIG. 1A, the support deck 130 includes an upper segment 140 positioned at the head end of the person support apparatus 100 which supports the upper body and/or the head and arms of a patient. The support deck 130 further includes a leg segment 160 positioned at the foot end of the person support apparatus 100 which supports the lower body and/or the legs of a patient. The support deck 130 includes a torso segment 150 that is positioned between the upper segment 140 and the leg segment 160 in the longitudinal direction which supports a torso and/or a mid-section of a patient.

Each of the upper segment 140, the torso segment 150, and the leg segment 160 include generally planar surfaces that support a patient on the person support apparatus 100. In some embodiments, the upper segment 140, the torso segment 150, and/or the leg segment 160 may include contoured or shaped surfaces that accommodate a patient. For example, in the embodiment depicted in FIG. 1A, the upper segment 140 includes a pillow portion 144, and arm portions 142 that accommodate a patient's head and arms, respectively. The torso segment 150 and the leg segment 160 may similarly include features and/or contours that accommodate a patient's torso and lower body, respectively.

Figure 3A:
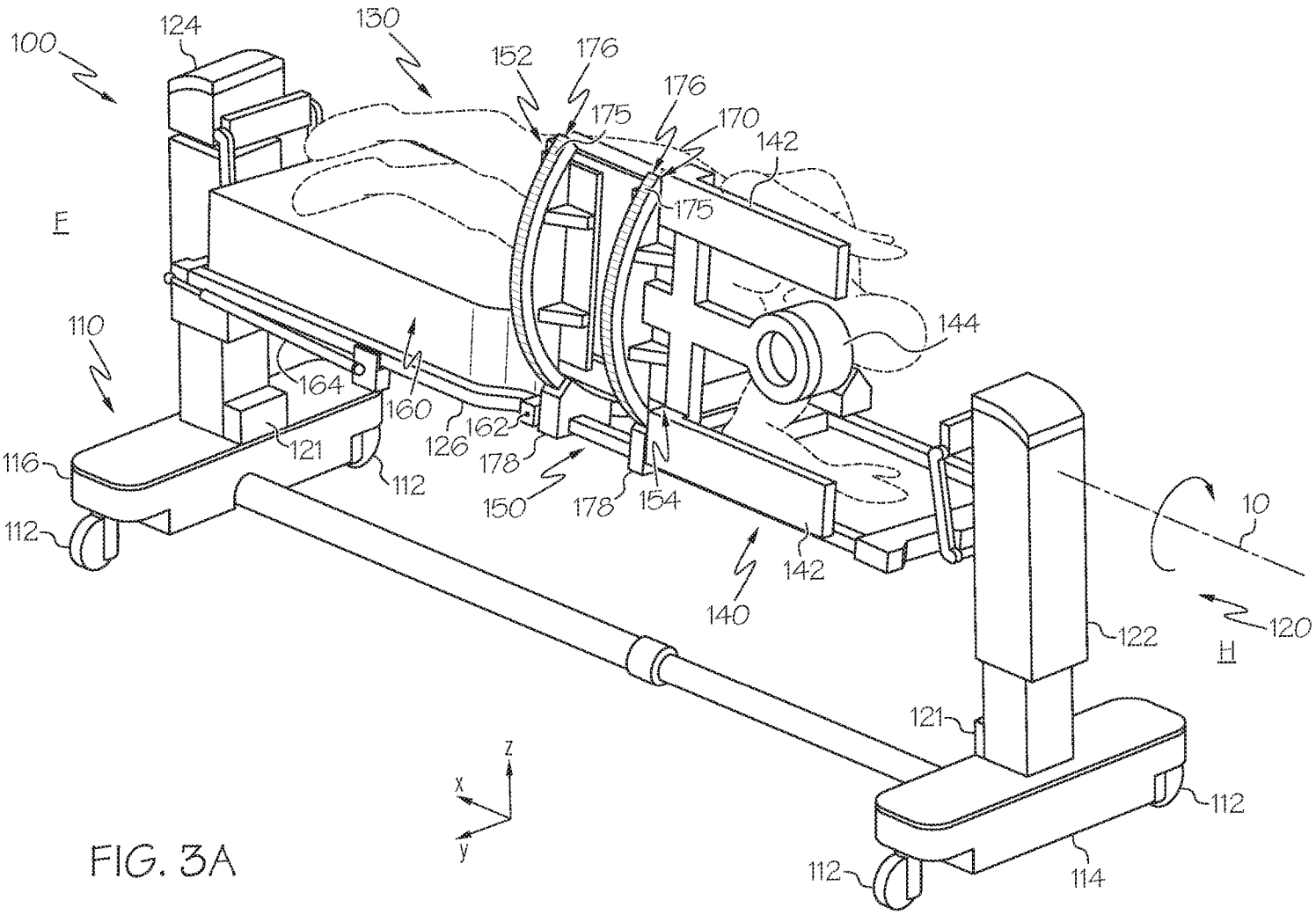
FIG. 3A schematically depicts a perspective view of the person support apparatus of FIG. 1A with a patient in a lateral position according to one or more embodiments shown or described herein.
Figure 3B:
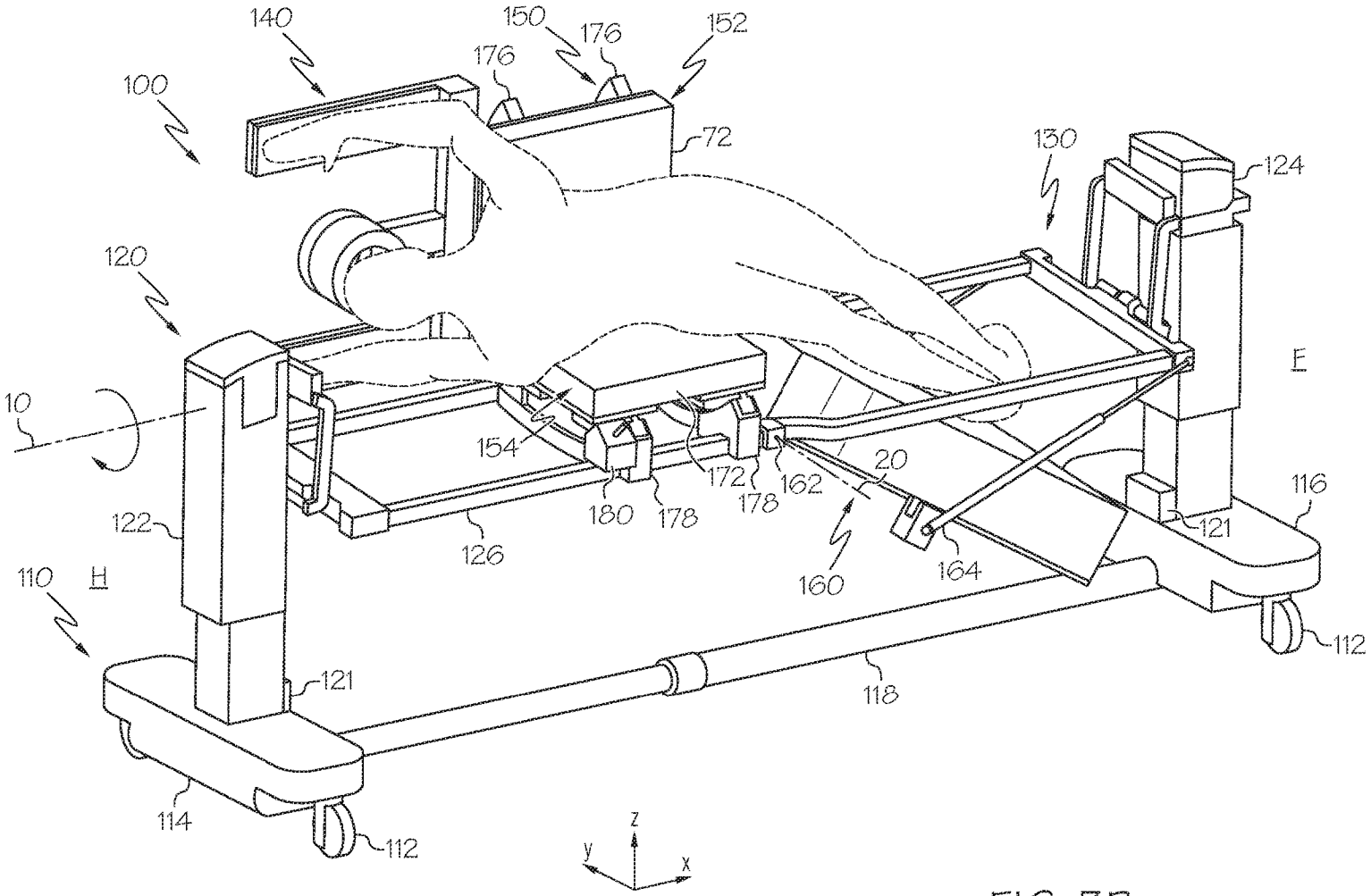
FIG. 3B schematically depicts another perspective view of the person support apparatus of FIG. 1A with a patient in a lateral position according to one or more embodiments shown or described herein.

Referring to FIG. 3B, the leg segment 160 is pivotally coupled to the longitudinal frame 126 at a leg segment pivot 162. The leg segment 160 pivots about an axis 20 at the leg segment pivot 162, where the axis 20 extends in the lateral direction. The leg segment 160 may be coupled to the longitudinal frame 126 by one or more dampers 164 that dampen movement of the leg segment 160 about the leg segment pivot 162. The one or more dampers 164 may include a variety of dampers, including, but not limited to, a linear damper or the like.

By pivoting at the leg segment pivot 162, the leg segment 160 may be lowered in the vertical direction with respect to the torso segment 150 and the upper segment 140. By lowering the leg segment 160 in the vertical direction, a patient's legs and lower body may be positioned lower than the torso of the patient, which may assist with aligning and orienting a patient during surgery. While the leg segment 160 is described and depicted as being pivotally coupled to the longitudinal frame 126, it should be understood that the leg segment 160 may be rigidly coupled to the longitudinal frame 126 and the torso segment 150 and/or the upper segment 140 may be pivotally coupled to the longitudinal frame 126.

Figure 1B:
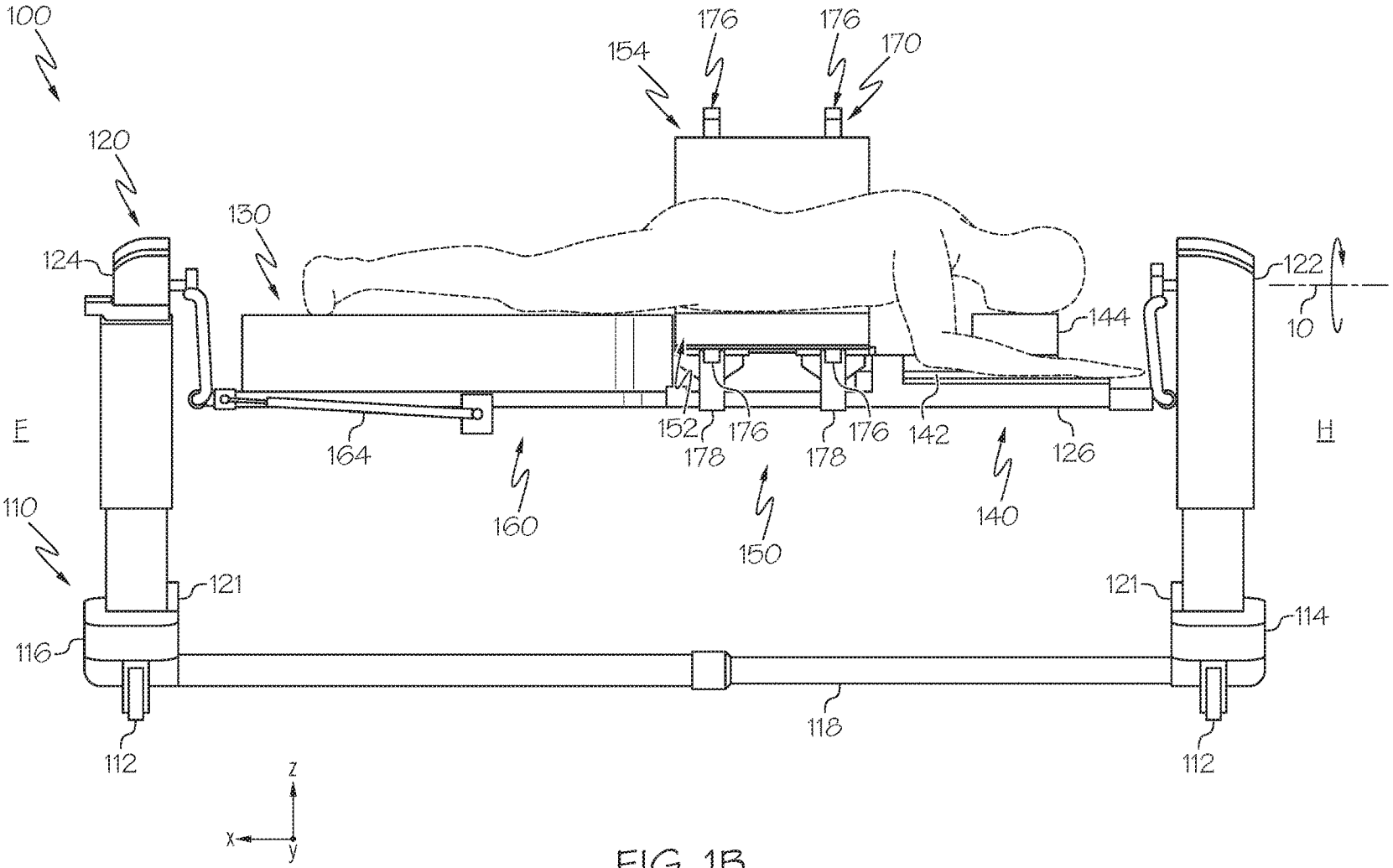
FIG. 1B schematically depicts a side view of the person support apparatus of FIG. 2A according to one or more embodiments shown or described herein.
Figure 1C:
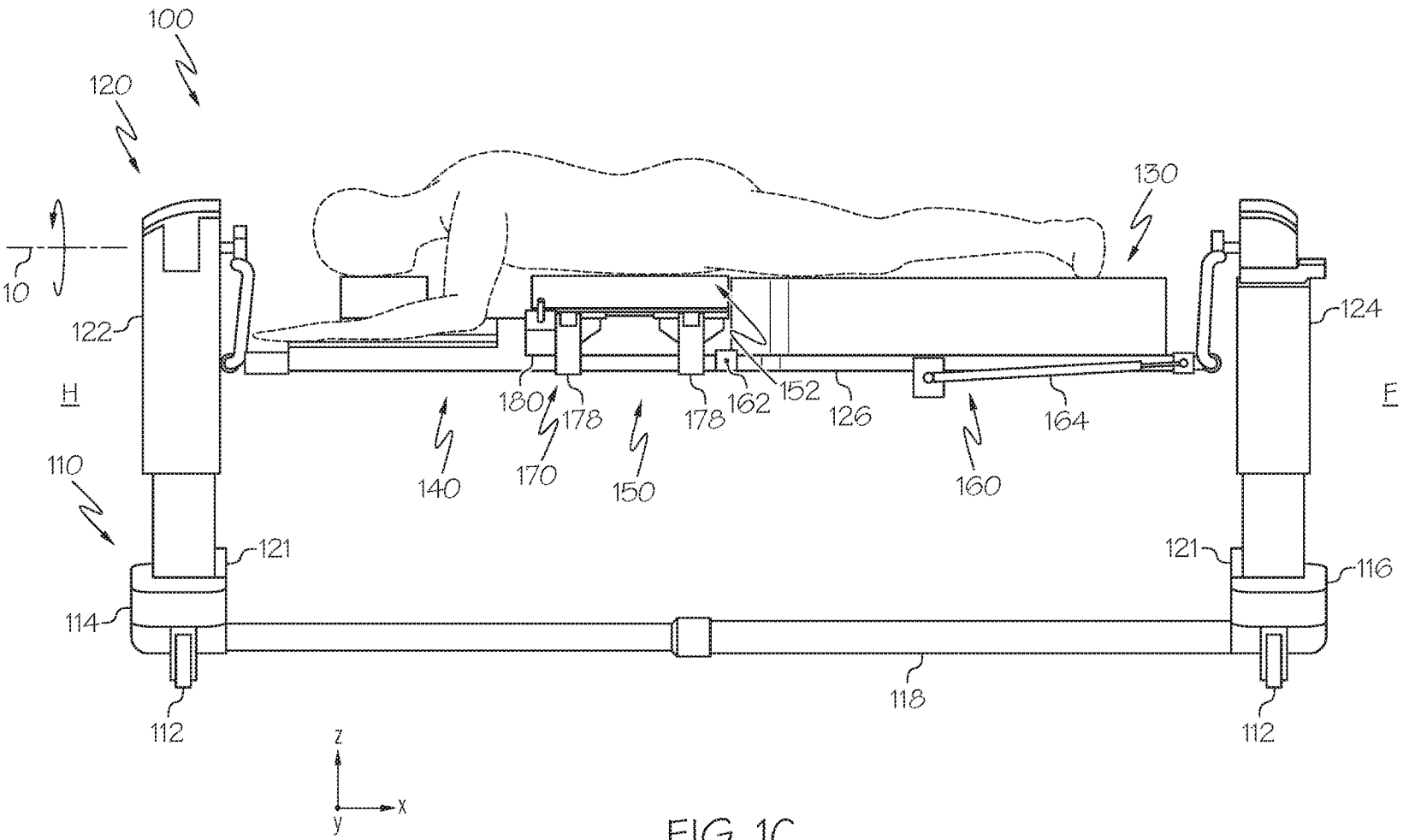
FIG. 1C schematically depicts another side view of the person support apparatus of FIG. 2A according to one or more embodiments shown or described herein.

Referring to FIG. 1B, the torso segment 150 includes one or more portions that may be selectively and severally coupled to one another. In the embodiment depicted in FIG. 1B, the torso segment 150 includes a first portion 152 that is severally coupled to a second portion 154. As shown in FIG. 1C, the second portion 154 (FIG. 1B) is severally coupled to and may be removed from the first portion 152. The first portion 152 and the second portion 154 of the torso segment 150 are oriented transverse to one another. The first portion 152 and the second portion 154 of the torso segment 150 facilitate repositioning of a patient on the person support apparatus 100, as will be described in greater detail herein.

Referring again to FIG. 1A, a repositioning assembly 170 is coupled to the torso segment 150. Additionally or alternatively, the repositioning assembly 170 may be coupled to the upper segment 140. The repositioning assembly 170 facilitates repositioning of a patient on the person support apparatus 100 and includes a pair of rocker members 176 coupled to the second portion 154 of the torso segment 150 and a pair of rocker members 176 coupled to the first portion 152 (FIG. 1B) of the torso segment 150. While the embodiment shown in FIGS. 1A and 1B depicts a pair of rocker members 176 coupled to each of the first portion 152 and the second portion 154 of the torso segment 150, it should be understood that a single rocker member 176 or multiple rocker members 176 may be coupled to each of the first portion 152 and the second portion 154 of the torso segment 150.

Ones of the rocker members 176 coupled to the first portion 152 of the torso segment 150 and ones of the rocker members 176 coupled to the second portion 154 are aligned with one another in the longitudinal direction and generally extend in a direction that is transverse to the longitudinal direction. The rocker members 176 are movably coupled to the primary support frame 120. In particular, the rocker members 176 are movably coupled to at least one guide 178 that is coupled to the longitudinal frame 126 of the primary support frame 120.

In embodiments, the rocker members 176 and/or the at least one guide 178 have a curved or arced shape such that the rocker members 176 rotate about an axis 10 with respect to the primary support frame 120, where the axis 10 extends in the longitudinal direction. The rocker members 176 and/or the at least one guide 178 include a radius of curvature that generally corresponds to a radius 12 extending from the axis 10 to the rocker members 176.

The rocker members 176 may include a toothed member 175 that is engaged with the at least one guide 178. The toothed member 175 may be positioned on an outer circumference of the rocker members 176. Alternatively or additionally, the toothed member 175 may be positioned on a side face of the rocker members 176. An actuator 180 is coupled to at least one of the guides 178 and moves the rocker members 176 with respect to the primary support frame 120. The actuator 180 may include one or more gears or screws (not depicted) that are engaged with the toothed member 175 of the rocker members 176, such that the actuator 180 and the rocker members 176 are engaged with one another in a fashion similar to a rack and pinion configuration. As the actuator 180 drives the one or more gears or screws meshed with the toothed member 175, the actuator 180 moves rocker members 176 with respect to the at least one guide 178. In embodiments, the actuator 180 may include various actuators, including, but not limited to an electric motor, a hydraulic actuator, a pneumatic actuator, or the like.

Referring to FIG. 4, the actuator 180 is communicatively coupled to the electronic controller 200. The electronic controller 200 sends signals to the actuator 180 which command the actuator 180 to move the rocker members 176 with respect to the primary support frame 120. In embodiments, the actuator 180 may include various actuators including, but not limited to an electrical motor or the like. A healthcare professional may utilize the user input 210 to send a signal to the electronic controller 200 to command the actuator 180 to move the rocker members 176 with respect to the primary support frame 120.

In various embodiments, the controller 200 further is communicatively coupled with one or more removable components of the person support apparatus 100 and or to one or more sensors of the person support apparatus adapted to determine the presence or absence of the one or more removable components, such as described below with respect to FIG. 6. In one embodiment, for example, the controller 200 is adapted to communicatively couple with at least one removable component of the person support apparatus. The controller is adapted to determine the absence or presence of the at least one removable component. In response to the determination, the controller is further adapted to disable at least one movement of the person support apparatus in response to a determination that the at least one removable component is not present or enable the at least one movement in response to a determination that the at least one removable component is present.

Referring again to FIG. 1A, the actuator 180 moves the rocker members 176 with respect to the at least one guide 178, the actuator 180 rotates the rocker members 176 about the axis 10 with respect to the primary support frame 120. As the first portion 152 and the second portion 154 of the torso segment 150 are coupled to the rocker members 176, when the rocker members 176 rotate about the axis 10 with respect to the primary support frame 120, the first portion 152 and the second portion 154 of the torso segment 150 rotate about the axis 10 with respect to the primary support frame 120.

While the actuator 180 is depicted as being positioned proximate to the torso segment 150 and as being directly engaged with the rocker members 176, it should be understood that the actuator 180 may be positioned at any suitable position on the person support apparatus 100 and may be engaged with the rocker members 176 through a variety of mechanical linkages.

The rocker members 176, the guides 178, the actuator 180, and the first portion 152 and the second portion 154 of the torso segment 150 are formed from materials such that the person support apparatus 100 may be suitable for use with a variety of medical equipment, such as an X-ray machine. In embodiments, each of the rocker members 176, the guides 178, the actuator 180, and the first portion 152 and the second portion 154 of the torso segment 150 may be formed from a variety of materials, including, but not limited to, polymers, composites, resins, carbon fiber or the like.

The person support apparatus 100, and in particular the repositioning assembly 170 of the person support apparatus 100, repositions a patient by rotating the first portion 152 and the second portion 154 of the torso segment 150 about axis 10 with respect to the primary support frame 120. For example, a patient may initially be positioned in a prone position, as depicted in FIG. 1A. During a surgical procedure, such as a spinal procedure, it may be necessary to reposition the patient from the prone position to a lateral position in which the patient is laying on his or her side, as depicted in FIG. 3A. To facilitate repositioning of the patient, the person support apparatus 100, and in particular the repositioning assembly 170, is repositionable between a first position and a second position and intermediate positions therebetween.

Referring to FIG. 1A, the person support apparatus 100 is initially positioned in a first position, in which the patient may be initially in the prone position. In the first position, the first portion 152 of the torso segment 150 is substantially co-planar with the horizontal plane (i.e., the X-Y plane as depicted) and may be co-planar with the longitudinal frame 126 of primary support frame 120. The first portion 152 of the torso segment 150 may also be substantially co-planar with the upper segment 140 and/or the leg segment 160 when the person support apparatus 100 is in the first position. The second portion 154 of the torso segment 150 is severally coupled to and is oriented transverse to the first portion 152 of the torso segment 150. Accordingly, the second portion 154 of the torso segment 150 is also oriented transverse to the longitudinal frame 126 in the first position.

Figure 2:
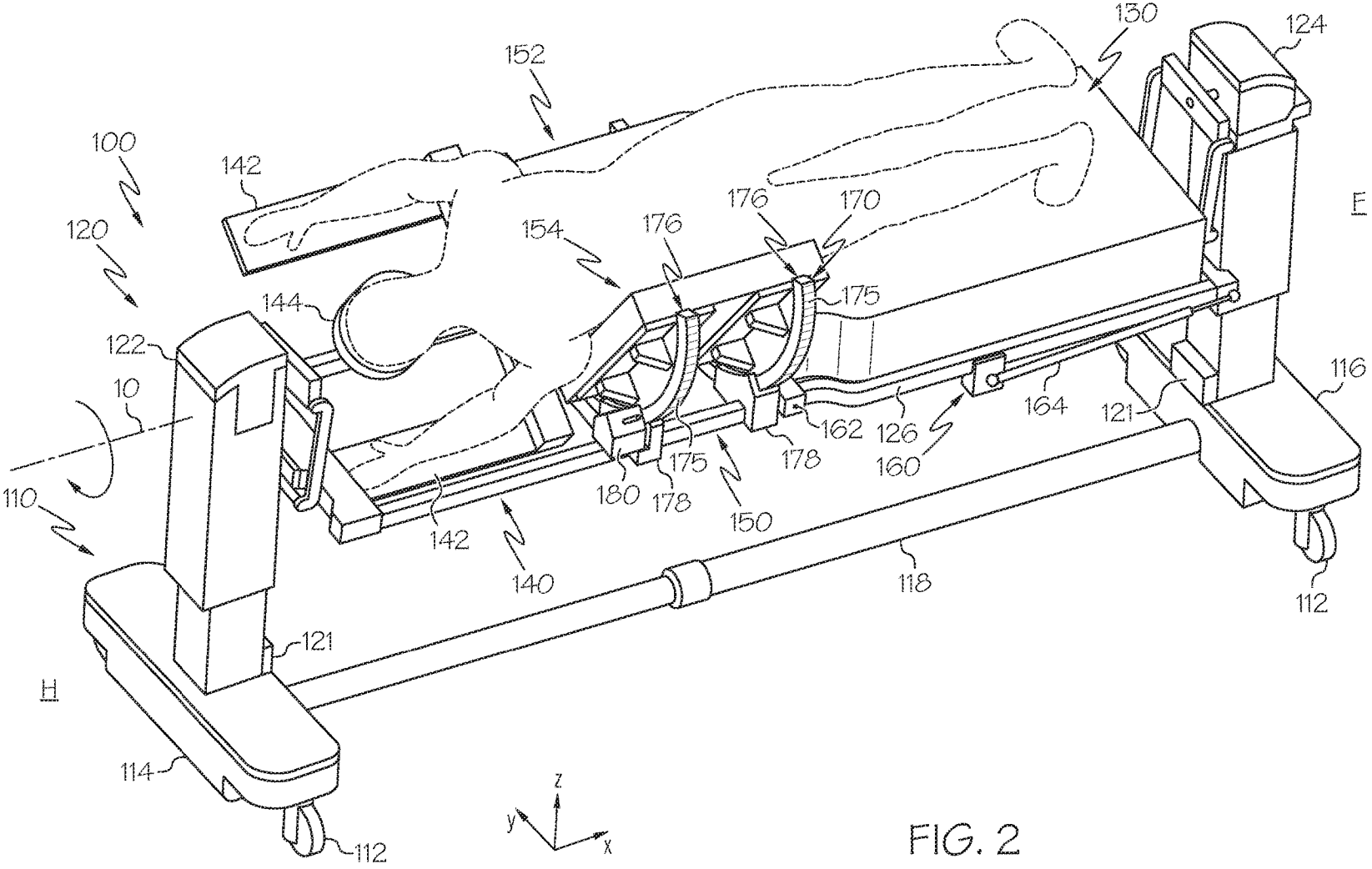
FIG. 2 schematically depicts a perspective view of the person support apparatus of FIG. 1A repositioning a patient from a prone position to a lateral position according to one or more embodiments shown or described herein.

Referring to FIG. 2, to reposition the person support apparatus 100 between the first position and the second position, the actuator 180 moves one of the rocker members 176 and the first portion 152 and/or the second portion 154 of the torso segment 150 that are coupled to the rocker members 176. In particular, the actuator 180 rotates the rocker members 176 and the first portion 152 and the second portion 154 about the axis 10. In the embodiment depicted in FIG. 2, the upper segment 140 is coupled to the first portion 152 of the torso segment 150 such that the upper segment 140 rotates about the axis 10 with the first portion 152 of the torso segment 150. In other embodiments, the torso segment 150 is not coupled to either the upper segment 140 or the leg segment 160 such that the torso segment 150 rotates about the axis 10 while the upper segment 140 and the leg segment 160 remain stationary.

The rocker member 176 that is coupled to the first portion 152 continues to rotate and the actuator 180 engages the rocker member 176 that is coupled to the second portion 154 of the torso segment 150. Once engaged with the rocker member 176 that is coupled to the second portion 154 of the torso segment 150, the actuator 180 continues to rotate the torso segment 150 to reposition the person support apparatus 100 into the second position.

Referring to FIG. 3A, the person support apparatus 100 is depicted in the second position. In the second position, the second portion 156 of the torso segment 150 is substantially co-planar with the horizontal plane (i.e., the X-Y plane as depicted), thereby positioning the patient in a lateral position. In particular, the patient's side is positioned on the second portion 156 of the torso segment 150, which is substantially co-planar with the longitudinal frame 126 such that the patient is laying on his or her side. As described above, the second portion 154 of the torso segment 150 is oriented transverse to the first portion 152 of the torso segment 150. Accordingly, when the person support apparatus 100 is in the second position, the first portion 152 is oriented transverse to the longitudinal frame 126. Once the person support apparatus 100 is in the second position, the first portion 152 of the torso segment 150 may be removed from the second portion 154.

While the person support apparatus 100 is described and depicted as showing the repositioning assembly 170 moving a patient between a prone position and a lateral position, it should be understood that the person support apparatus 100 may be utilized to move a patient between additional rotational positions. For example, the person support apparatus 100 may be utilized to reposition a patient between the lateral position, as shown in FIG. 3A and a supine position (not depicted), or between the supine position and a lateral position. Further, while the actuator 180 is depicted as rotating the torso segment 150 in the clockwise direction about the axis 10, it should be understood that the actuator 180 may rotate the torso segment 150 in the counterclockwise direction about the axis 10.

Figure 5:
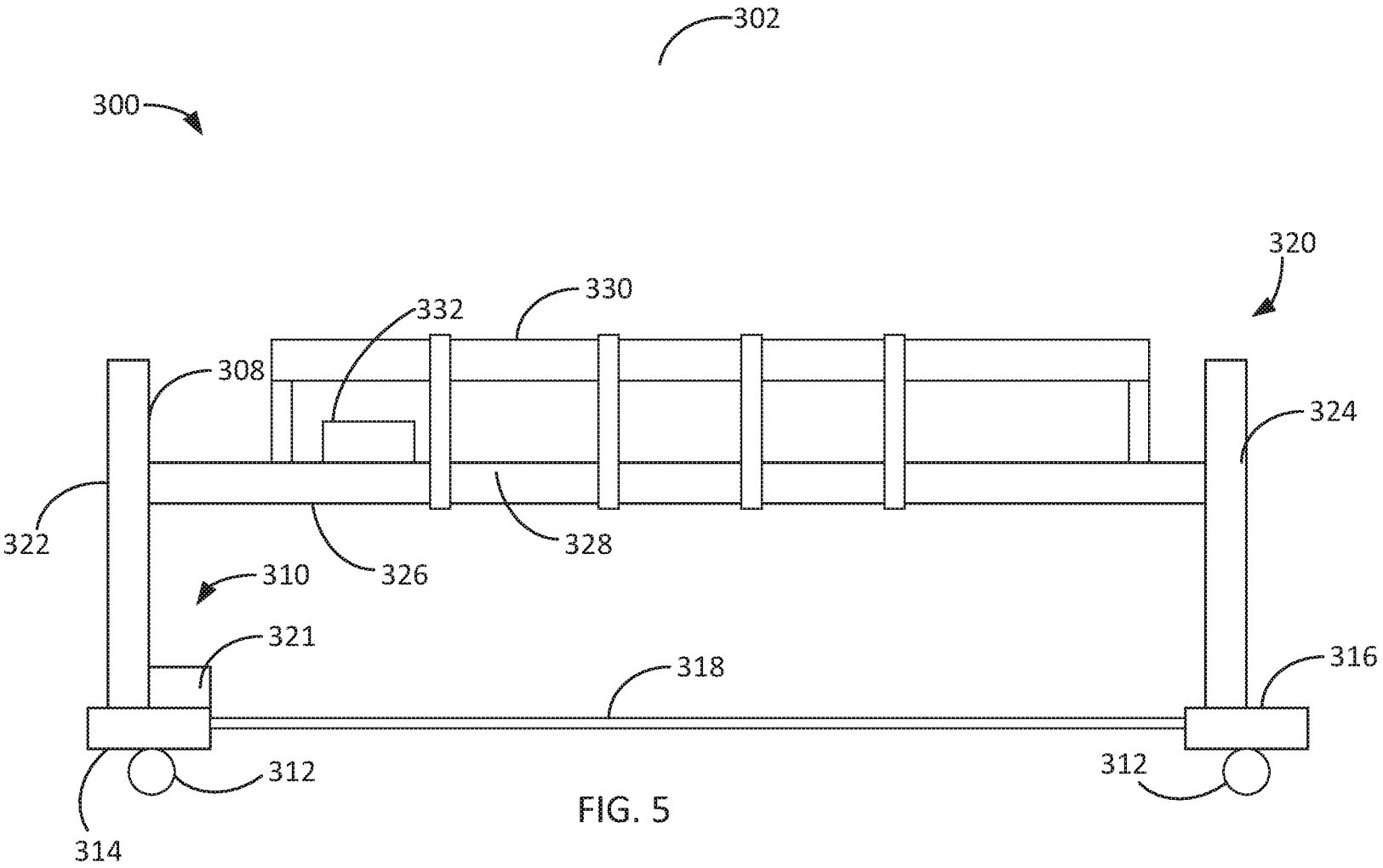
FIG. 5 schematically depicts a perspective view of another implementation of a person support apparatus according to one or more embodiments shown or described herein.

FIG. 5 schematically depicts a perspective view of another implementation of a patient support apparatus 300. In this implementation, the person support apparatus 300 is an operating table adapted to support and secures a patient for a surgical or diagnostic procedure. In this particular implementation, the apparatus 300 comprises a dual-column operating column with one or more patient restraints. The persons support apparatus generally comprises a base frame 310, a primary support frame 320 that is supported by a abase frame and a support deck 330 coupled to the primary support frame 320. The base frame 310 of the person support apparatus includes a forward portion 314 positioned at a head end of the person support apparatus 300 and a rearward portion 316 positioned at a foot end of the person support apparatus 300. The forward portion 314 and rearward portion 316 are spaced apart from one another in the longitudinal direction and may be coupled to one another by a central portion 318 that extends between the forward portion 314 and the rearward portion 316 in the longitudinal direction. The central portion may be extendable and/or retractable in the longitudinal direction, thereby increasing or decreasing the distance between the forward portion 314 and the rearward portion 316 in the longitudinal direction. In embodiments, the forward portion 314 and rearward portion 316 are coupled to a plurality of rollers 312, such that the person support apparatus 300 may be moved along a surface such as a floor.

The primary support frame 320 extends upward from the base frame 310 of the person support apparatus 300. In the embodiment depicted in FIG. 5, for example, the primary support frame 320 includes a forward column 322 that extends upward from the forward portion 314 of the base frame 110 in the vertical direction. The primary support frame 320 further includes a rearward column 324 that extends upward from the rearward portion 316 of the base frame 310 in the vertical direction. The forward column 322 is positioned at the head end of the person support apparatus 300 and the rearward column 324 is positioned at the foot end of the person support apparatus 300, and the forward column 322 is spaced apart from the rearward column 324 in the longitudinal direction. In embodiments, the forward column 322 and the rearward column 324 are coupled to the forward portion 314 and the rearward portion 316 of the base frame 310, respectively. Alternatively, the forward column 322 and the rearward column 324 may be integral with the forward portion 314 and the rearward portion 316 of the base frame 310, respectively.

The primary support frame 320 includes a longitudinal frame 326 that is positioned above the base frame 310 in the vertical direction and that extends between the forward column 322 and the rearward column 324 in the longitudinal direction. In the embodiment depicted in FIG. 5, the longitudinal frame 326 generally includes patient prone supports 328 and patient supine supports 330. A plurality of safety straps 332 (and/or other safety restraints) extend at least partially around the patient prone supports 328 and patient supine supports 330 to restrain a patient to the persons support apparatus (e.g., within the longitudinal frame 326, to at least one of the patient supports 328, 330 and/or to another component of the patient support apparatus 300) during use of the person support apparatus 300 (e.g., during a medical procedure or movement of the patient on the patient support apparatus). The longitudinal frame 326 may further extend generally in a horizontal plane and/or may include one or more contours (e.g., patient supports) that extend out of the horizontal plane (e.g., the X-Y plane as depicted with respect to the patient support apparatus 100 shown in FIG. 1A). Other supports, restraints or other components (e.g., arm, head, neck, wrist, hand, ankle, foot or other supports) may also be used depending on a medical procedure to ensure patient, medical personnel equipment position, safety and/or comfort. A removable head restraint 332, for example, may be positioned (e.g., engaged to the person support apparatus 300) to support a patient's head when the patient is to be oriented in a prone position during a procedure. Other restraints, supports or the like may also be used depending on a position of the patient on the person support apparatus 300.

The forward column 322 and the rearward column 324 may be adjustable in the vertical direction such that the forward column 322 and the rearward column 324 may raise or lower the longitudinal frame 326 with respect to the base frame 310 in the vertical direction. In embodiments, at least one column actuator 321 coupled to the forward column 322 and/or the rearward column 324 and moves the forward column 322 and the rearward column 324 upward and downward in the vertical direction with respect to the base frame 310. The column actuator 321 may be a powered actuator, such as an electric motor or the like, or may be a manually powered, such as by a footpedal, a crank, or the like. The column actuator 321 include a linear actuator, such as a screw, a wheel and axle, a cam, a hydraulic actuator, a pneumatic actuator, a piezoelectric actuator, an electromechanical actuator, or the like.

Figure 8:
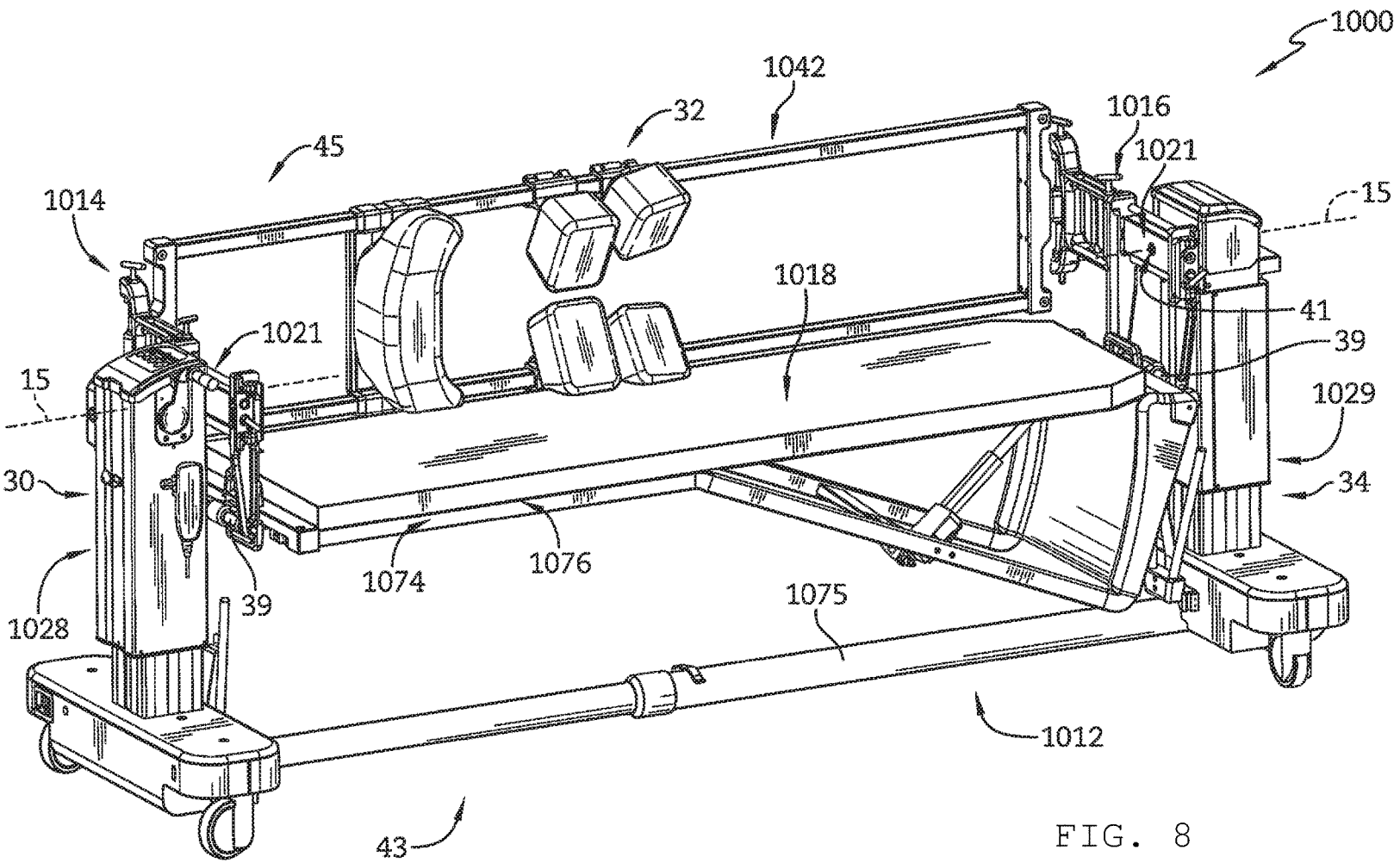
FIG. 8 schematically depicts a perspective view of another illustrative implementation of a person support apparatus that includes a tower base and patient support tops attached to the tower base by main brackets according to one or more embodiments shown or described herein.

Another illustrative implementation of a person support apparatus 1000 is shown in FIG. 8. In this particular implementation, the person support apparatus 1000 includes a tower base 1012, main brackets 1014, 1016 and patient support tops 1018, 1042 as shown in FIG. 8. Main brackets 1014, 1016 are configured to support patient support tops 1018, 1042 at about ninety (90) degrees relative to each other to support various patient body positions. Person support apparatus 1000 includes a head end 30, a midsection 32, a foot end 34, and left 43 and right 45 lateral sides as shown in FIG. 8. In this illustrative implementation, the patient support top 1018 is configured to support a patient lying in a lateral position (or supine position) and patient support top 1042 is configured to support the patient lying in a prone position.

Tower base 1012 supports main brackets 1014, 1016 for controlled translatable movement along vertical (i.e., raising, lowering and tilting when the table 1000 is in the orientation shown in FIG. 8) and rotational movement about an axis 15. Main brackets 1014, 1016 connect the patient support tops 1018, 1042 to the tower base 1012 respectively at the head end 30 and the foot end 34 of the person support apparatus 1000 as shown in FIG. 8 to provide adaptable support to surgical patient. Each main bracket 1014, 1016 connects to a connection bar 1021 that is attached to the respective elevator tower 1028, 1029 of the tower base 1012 by a mounting post 41 for controlled rotation.

Figure 9:
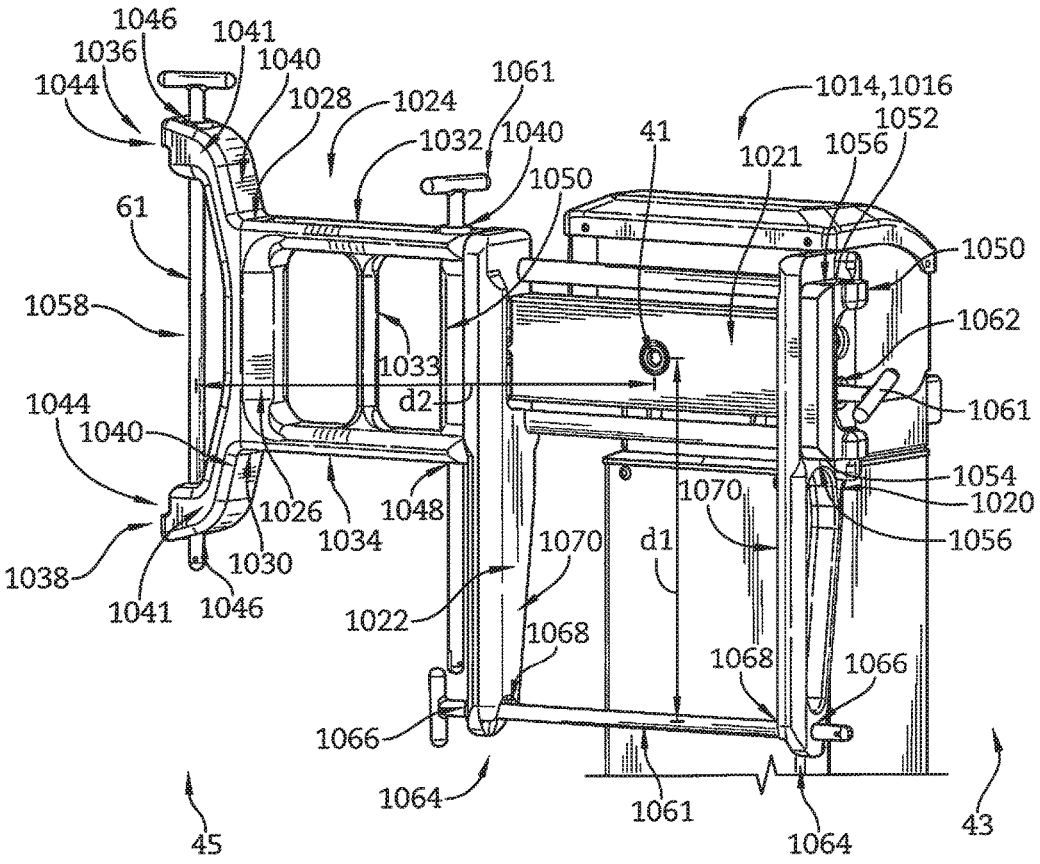
FIG. 9 schematically depicts a perspective view of the main brackets of the person support apparatus of FIG. 8 according to one or more embodiments shown or described herein.

As best shown in FIG. 9, main brackets 1014, 1016 each illustratively include a pair of main rails 1020, 1022 attached to the connection bar 1021 and a prone bracket 1024 coupled to one of the main rails 1020, 1022. In the orientation shown in FIG. 9, the main rails 1020, 1022 illustratively extend vertically and attach to opposite ends of the connection bar 1021. Each main rail 1020, 1022 attaches to the connection bar 1021 by receiving a connection pin 1061 inserted through the connection bar 1021 and through an attachment hole 1062 of each main rail 1020, 1022.

The main rails 1020, 1022 each illustratively include a connection shelf 1050 for connection with the prone bracket 1024. Thus, bracket 1024 can be mounted to rail 1020 on one side of table 100 or to rail 1022 on the other side of table 1000. The connection shelves 1050 are each illustratively formed as a protrusion extending from the respective main rail 1020, 1022 and defining a first surface 1052 facing in an upward direction (in the orientation shown in FIG. 9) and a second surface 1054 facing in a direction opposite to the first surface 1052. The first and second surfaces 1052, 1054 each have an attachment hole 1056 defined therein to receive a connection pin 1061 for attachment of the prone bracket 1024 to shelves 1050 of the respective rail 1020, 1022 of bracket 1020.

The prone brackets 1024 of each main bracket 1014, 1016 are configured for connection to patient support top 1042. In the illustrative implementation shown in FIG. 9, for example, prone brackets 1024 are selectively coupled to one of the main rails 1020, 1022 and extend laterally therefrom (in the orientation as shown in FIG. 9). Each prone bracket 1024 illustratively includes a main body 1026 extending vertically (in the orientation as shown in FIG. 9) between opposite ends 1028, 1030, a pair of rail arms 1032, 1034 extending from the opposite ends 1028, 1030 for connection with one of the main rails 1020, 1022, and a pair of support legs 1036, 1038 that extend from the main body 1026 in a direction opposite from the rail arms 1032, 1034 towards a prone connection end 1044.

Rail arms 1032, 1034 illustratively connect with one of the main rails 1020, 1022 via connection pin 1061 as shown in FIG. 9. The rail arms 1032, 1034 illustratively extend from the main body 1026 parallel to each other and include a brace 1033 attached between the rail arms 1032, 1034. The rail arms 1032, 1034 are illustratively spaced apart from each other by a distance substantially equal to the distance between the first and second surfaces 1052, 1054 of the connection shelves 1050 to engage or abut at least one of the respective surface 1052, 1054 upon connection with the main bracket rails 1020, 1022. Each rail arm 1032, 1034 illustratively includes an attachment hole 1048 penetrating therethrough on an end positioned away from the main body 1026. A user can engage the rails arms 1032, 1034 with the surfaces 1052, 1054, respectively, and align the attachment holes 1048 of each rail arm 1032, 1034 with the attachment holes 1056 of the surfaces 1052, 1054 of the respective connection shelf 1050 to receive a connection pin 1061 inserted therethrough to connect the prone bracket 1024 to one of the main arms 1020, 1022 of bracket 1020.

Support legs 1036, 1038 illustratively extend from the main body 1026 and terminate at the respective connection ends 1044 as shown in FIG. 9. Each support leg 1036, 1038 illustratively includes a stem 1040 attached to the main body 1026 and extending in an inclined manner, mostly in the vertical direction (in the orientation shown in FIG. 9) and a branch 1041 attached to the stem 1040 and extending therefrom mostly in the horizontal direction (again, in the orientation shown in FIG. 9) to the connection end 1044. In the illustrative embodiment, the stems 1040 of each leg support 1036, 1038 of the same prone bracket 1024 illustratively extend from opposite ends 1028, 1030 of the main body 1026 in opposing directions. The connection ends 1044 illustratively define a connection space 1058 therebetween for receiving a prone pin tube 53 of the prone patient support top 1042.

Each branch 1041 of the support legs 1036, 1038 illustratively includes an attachment hole 1046 defined therein and penetrating therethrough in the vertical direction (in the orientation shown in FIG. 9). A user can align the prone pin tube 53 with the attachment holes 1046 and insert the connection pin 1061 therethrough to connect the prone patient support top 1042 to the prone bracket 1024. The prone patient support top 1042 is thus illustratively supported with a generally perpendicular orientation relative to patient support top 1018 to accommodate positioning of a patient's body between lateral and prone positions as described above.

In the illustrative implementation shown in FIG. 9, main brackets 1014, 1016 each attach to a respective end of the patient support tops 1018, 1042. The main rails 1020, 1022 illustratively extend parallel and in spaced apart relation to each other from attachment with the connection bar 1021 to a connection end 1064. Main rails 1020, 1022 each illustratively include an attachment hole 1066 penetrating therethrough and extending between lateral sides 43, 45 for receiving a connection pin 1061 therethrough to attach the patient support 1018 with the main brackets 1014, 1016.

A connection slot 1068 is defined at the distal end of each main rail 1020, 1022 on an interior side 1070 thereof. The connection slots 1068 are illustratively embodied as recesses formed in the interior side 1070 and extending generally straight for a length from the connection end 1064. Attachment holes 1066 communicate with respective slots 1068. In the illustrative implementation, the length of extension of connection slots 1068 is oriented generally vertically (in the orientation of the main brackets 1014, 1016 shown in FIG. 9) to allow ends of a pin tube 39 of the patient support 1018 to be received therein so as to be aligned with the attachment holes 1066 to receive the connection pin 1061 therethrough.

The connection slots 1068 receive the ends of the pin tube 39 when aligned with the attachment holes 1066 (as shown in FIG. 8). By arranging the connections slots 1068 to extend generally vertically (in the orientation as shown in FIGS. 8 and 9), the pin tube 39 is blocked against resting within the connection slots 1068 without a connection pin 1061 inserted through each of the attachment holes 1066 and the pin tube 1068 in at least some positions of the surgical support 1000, and preferably most positions of surgical support 1000, and more preferably all positions of surgical support 1000. For example, the connection slots 1068 are illustratively arranged at 5 degrees from vertical, but in some embodiments may be arranged with any angle from about negative (−) 89 to about 89 degrees from vertical in the orientation as shown in FIG. 9. This arrangement can reduce the risk of the patient support 1018 falling due to misperception by a user that a connection pin 1061 is inserted through each of the attachment holes 1066 and the pin tube 39 by eliminating an unstable rest condition between the pin tube 39 and the main bracket 1014, 1016.

In the illustrative embodiment shown in FIG. 9, a distance $d_1$ is defined between the centerlines of the mounting post 41 and the connection pin 1061 extending through the attachment holes 1066 of the main bracket 1014, 1016 and a distance 62 is defined between the centerlines of the mounting post 41 and the connection pin 1061 extending through the attachment holes 1046 of the prone bracket 1024. In the illustrative implementation, the distance $d_1$ is less than the distance 62 such that mistaken attachment of the patient support 1018 to the prone bracket 1024 (instead of to the connection end 1044 of the main rails 1020, 1022) causes interference between the patient support top 1018 and the base 1012, more specifically causes a frame 1074 of the patient support top 1018 to contact a cross bar 1075 of the base tower 1012 when the prone brackets 1024 are rotated between about the about five (5) o'clock and about seven (7) o'clock positions relative to the axis 15, to discourage attachment of the patient support top 1018 with the prone bracket 1024.

Figure 6:
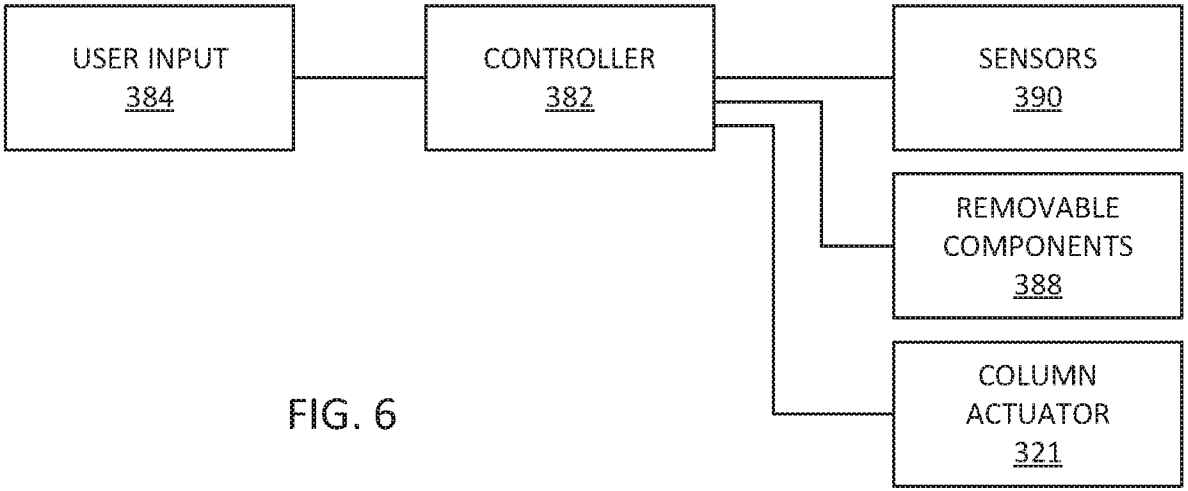
FIG. 6 schematically depicts a block diagram of an example control system for the person support apparatus of FIG. 5 according to one or more embodiments shown or described herein.

Referring to FIG. 6, in embodiments where the column actuator 321 includes an electric motor, the column actuator 321 may be communicatively coupled to an electronic controller 382. The electronic controller 382 includes a processor and a memory storing computer readable and executable instructions, which, when executed by the processor, facilitate operation of the column actuator 321. In particular, the electronic controller 382 sends a signal to the at least one column actuator 321 to raise or lower the forward column 322 and/or the rearward column 324 in the vertical direction. A user input 384 is communicatively coupled to the electronic controller 382. The user input 384 includes a device that allows a user to input various parameters into the electronic controller 382 to facilitate operation of the person support apparatus 300. For example, a healthcare professional may utilize the user input 384 to send a signal to the electronic controller 382 to command the at least one actuator 321 to raise or lower the forward column 322 and/or the rearward column 324 in the vertical direction. In embodiments, the user input 384 may include various user input devices, including, but not limited to, graphical user interfaces (GUIs), keyboards, pendants, or the like. Similar to the person support apparatus 100 shown in FIGS. 1-4, other elements (e.g., actuators) of the persons support apparatus 300 of FIG. 5 may also be controlled to move any number of components of the person support apparatus 300 in a similar manner. The controller 382 may also control a second actuator 380 to control the actuator 380 to move other component(s) of the person support apparatus 300, such as to rotate the longitudinal frame 125 to a patient prone position, a patient supine position or any position in between, to angle the patient (or part of the patient) out of a horizontal position or to otherwise position a patient or one or more components of the persons support apparatus 300.

In some embodiments, the controller 382 (or another controller) may also monitor for one or more components to be attached to the persons support apparatus 300 and/or properly configured on the person support apparatus. If the controller 382 fails to detect a component or detects that the component is installed incorrectly, the controller may disable one or more functionalities of the person support apparatus 300 or issue an alarm via the user interface. In one implementation, for example, the controller 382 is communicatively coupled to one or more components 388 of the person support apparatus 300 (e.g., one of the attachment components or a sensor) to detect the presence of the components 388 attached to the apparatus 300 and/or the correct installation of the components.

In one implementation, for example, the controller 382 is communicatively coupled (e.g., wired or wirelessly) to the components and detects their installation. A component (e.g., safety straps, patient safety support or the like) may include an RFID transmitter adapted to communicate with the controller 382. In this implementation, the controller 382 receives a signal from the RFID transmitter when the component 388 is installed. Each component 388 may, for example, include a unique RF identifier so that the controller can distinguish between components coupled to the person support apparatus. Although RFIDs are described, other wired or wireless communications devices adapted to communicate with the controller 382 are also contemplated. A component of the person support apparatus, for example, may include Bluetooth, infrared, USB, Firewire, lightning or any other type of wired or wireless communication device adapted to communicate with the controller 382.

In other implementations, the person support apparatus 300 may include one or more sensors 390 for detecting the presence or absence of one or more components being attached to the apparatus 300. In this implementation, the controller 382 may also or alternatively be communicatively coupled to one or more sensors 390 as shown in FIG. 6. In this implementation, the controller 382 determines whether the one or more components are properly attached to the person support apparatus 300. The sensors for example, may include mechanical sensors, electrical sensors, electromechanical sensors or any other types of sensors.

Upon detection of a component, the controller may enable one or more functionalities of the person support apparatus. In the absence of the detection of the component, the controller 382 may similarly disable one or more functionalities of the person support apparatus.

In one implementation, for example, a person support apparatus has one or a flat table top, a prone top or a lateral top installed and a patient is on the table. If the controller 382 fails to detect safety straps attached to the table to secure the patient to the table, the controller 382 may disable the table top from tilting or rotating with the patient on the table.

The controller 382 may similarly detect that the person support apparatus 300 has a lateral top or prone top installed and a patient is on the support apparatus in a lateral decubitus position. In this instance, the controller 382 also detects the presence of a lateral and prone top and installed safety straps. In response to this determination, the controller 382 may allow the support apparatus 300 to rotate the patient up to 90 degrees only in the direction of the installed prone top.

The controller 382 may also detect that the apparatus 300 has a flat top installed and that a patient is on the flat top of the apparatus 382 in a supine position. In this instance, if the controller also detects that a head positioner support, a prone top and a plurality of safety straps are attached and properly installed to the apparatus 300, the controller 382 may allow a "flip" mode to be engaged and the apparatus is able to be rotated until the patient is turned over. If the controller 382, however, fails to detect the expected components installed, the controller 382 may disable the "flip" feature and prevent the person support apparatus 300 from rotating the flat top of the apparatus.

The controller 382 may also detect that a lateral top is installed on the apparatus 300. In this instance, the controller 382 may enable a powered leg drop feature of the lateral table but disable a 90 degree rotation feature.

These are merely examples of possible features that may be enabled or disabled via a controller of a person support apparatus. By monitoring for the presence or proper connection of one or more components of a person support apparatus and responsively enabling or disabling one or more features or motions of the apparatus 300, patient safety may be increased while still allowing a full complement of features to be available when the proper components are present and/or installed correctly.

Figure 7:
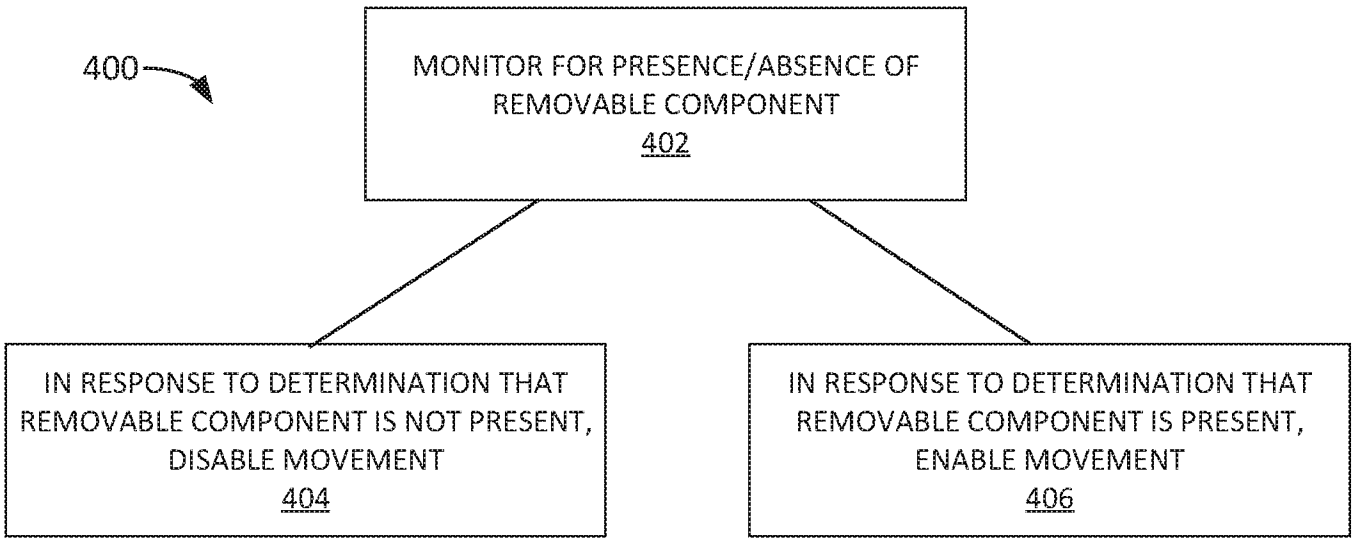
FIG. 7 depicts an example process 400 for controlling at least one movement of a person support apparatus according to one or more embodiments shown or described herein.

Referring to FIG. 7, an example process 400 for enabling or disabling one or more movement of a person support apparatus is provided. A controller monitors for a signal related to removable component of a person support apparatus in operation 402.

As discussed above, the controller may be adapted to communicate with the at least one removable component and/or a sensor of the person support apparatus adapted to detect the presence and/or absence of the at least one removable component via any wired or wireless communication method. The controller, for example, may include an RFID receiver for receiving an RF identifier from the at least one removable component of the person support apparatus. Similarly, the controller may be adapted to wirelessly communicate with a removable component and/or sensor via a Bluetooth, WiFi, infrared or other wireless communication method. The controller may also be adapted to communicate via a wired communication method, such as a USB communication, a Firewire communication, a lightning communication method or any other wired communications method.

In response to a determination that the at least one removable component is not present, the controller disables at least one movement of the person support apparatus in operation 404. Alternatively, or in addition to operation 404, the controller may, in response to a determination that the at least one removable component is present, enable the at least one movement of the person support apparatus in operation 406.

Figure 10:
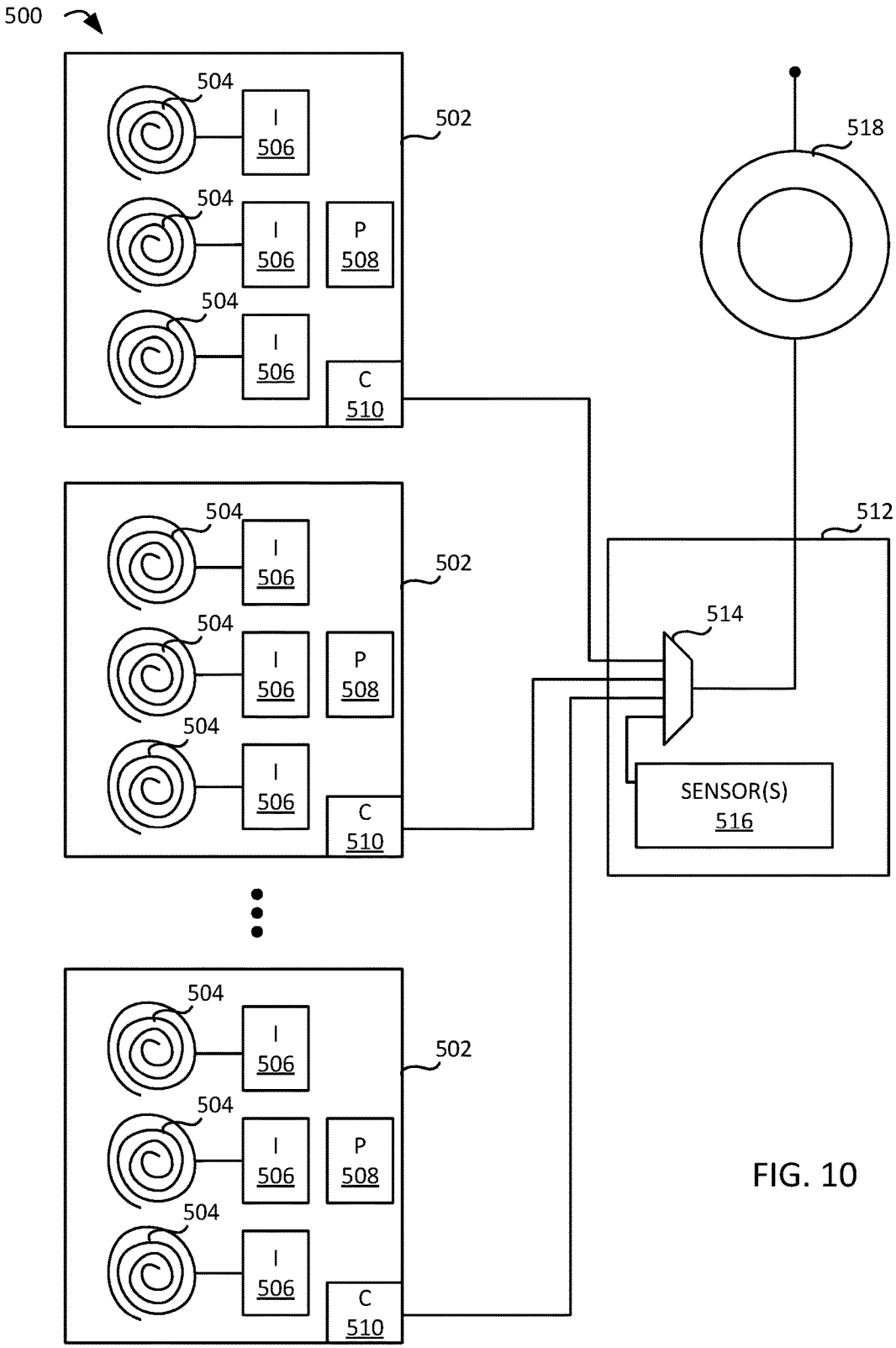
FIG. 10 schematically depicts a an example inductive sensor system communicatively coupled to a component of a person support apparatus table top according to one or more embodiments shown or described herein.

FIG. 10 shows a schematic view of an example sensor system 500 adapted to detect the absence or presence of one or more removable component of a person support apparatus. In this particular implementation, for example, the sensor system 500 comprises one or more individual sensor devices 502. The individual sensor device(s) 502 may be coupled to the person support apparatus and/or one or more removable components associated with the person support apparatus. In one implementation, for example, a plurality of sensor devices 502 may be coupled to a person support apparatus generally adjacent to a plurality of locations at which removable components associated with the person support apparatus are adapted to be coupled to the person support apparatus. Each sensor device 502 is adapted to detect and/or identify the presence or absence of at least one removable component associated with the removable component(s). In one implementation, for example, the removable component(s) may include an indicator device adapted to be detected and/or identified by at least one sensor device (see, e.g., FIG. 11). In another implementation, for example, the individual sensor device(s) 502 may be coupled to one or more removable components of a person support apparatus and adapted to detect and/or identify one or more indicators associated with (e.g., coupled to) the person support apparatus.

Each sensor device 502, in this example, comprises one or more inductive coil 504 (e.g., a PCB inductive coil), one or more corresponding inductive sensor 506, one or more proximity sensor 508 and one or more connector 510. The one or more inductive coil(s) 504, for example, may be adapted to detect to one or more indicators disposed on a person support apparatus and/or a removable component of the person support apparatus. A conductive or non-conductive indicator, for example, may be disposed on or otherwise coupled to the person support apparatus and/or removable component of the person support apparatus and affect one or more electrical property, magnetic property or other property associated with the sensor device. Although the particular implementation shown in FIG. 10 includes an inductive coil 504 and an inductive sensor 506 that are adapted to detect one or more changes in inductance associated with the inductive coil 504, other sensors utilizing other electrical, magnetic or other properties, such as but not limited to resistance, capacitance, electrical and/or electromagnetic fields or the like may also be used in the sensor device. Similarly, the sensor devices may be adapted to read one or more codes (e.g., RFID codes, barcodes or the like) associated with the person support apparatus and/or the one or more removable component of the person support apparatus.

In one particular implementation, for example, each sensor device comprises a plurality of individual sensor elements (collectively, 504, 506) (e.g., the three individual inductive sensor elements comprising inductive coils 504 and inductive sensors 506 shown in each sensor device 502 of FIG. 10). The plurality of individual sensor elements 504, 506 may, for example, individually detect a "digital" or "analog" level of a corresponding electrical, magnetic or other property caused at the sensor due to one or more indicator associated with the opposing person support apparatus and/or removable component of the person support apparatus. Each of the individual sensor elements 504, 506 in one implementation, for example, may identify binary or other digit of a code associated with the respective person support apparatus and/or removable component of the person support apparatus being detected.

The proximity sensor 508 may further be provided and adapted to determine whether a person support apparatus and/or a removable component associated with the person support apparatus is in proximity such that a code of the apparatus and/or component may be read via the sensor elements 504, 506 of the sensor device 502. In one particular implementation, the proximity sensor 508 may comprise a line-of-sight or other proximity sensor adapted to identify a reference point associated with the removable component(s) and/or person support apparatus or otherwise determine whether the component(s) and/or person support apparatus is in proximity such that a code of the apparatus and/or component may be read via the sensor elements 504, 506 of the sensor device 502.

As shown in FIG. 10, each sensor device may also include a connector 510 (e.g., wired or wireless connector) adapted to communicatively couple the sensor device(s) 502 to a connector board 512. The connector board 512 is adapted to communicatively couple to the sensor device(s) 502 via connectors 510 (e.g., via a wired or wireless connection) and receive data signals from the sensor device(s) 502. A plurality of data signal connections are coupled to a multiplexer 514 or other logic structure of the connector board 512. In this implementation, the connector board 512 further comprises one or more sensors 516 adapted to detect one or more additional conditions related to the person support apparatus and/or one or more removable components associated with the person support apparatus. In one implementation, for example, the sensors 516 may comprise an accelerometer, a gyroscope, an inertial combination unit and/or other sensor adapted to provide data such as, but not limited to, orientation and tilt data) of the person support apparatus and/or removable component(s). Data outputs of the sensors 516 may also be coupled to the input of the multiplexer 514 or other logic structure. The multiplexer 514 or other logic structure may be used to select one or more data signals for transmission via a connector 518 (e.g., wired or wireless) to a controller (see, e.g., FIG. 6). In a wired communication implementation, for example, a slip ring connector 518 (e.g., 360 degree or other rotation slip ring) or other coupling device may be used to couple the connector board 512 to the controller. By using the multiplexer or other logic structure, such as an I/O expander, the number of wired connections extending through the slip ring connector 518 may be reduced. In other implementations, however, the multiplexer or other logic structure may be omitted if the connector supports the wires or other communications links.

Figure 11:
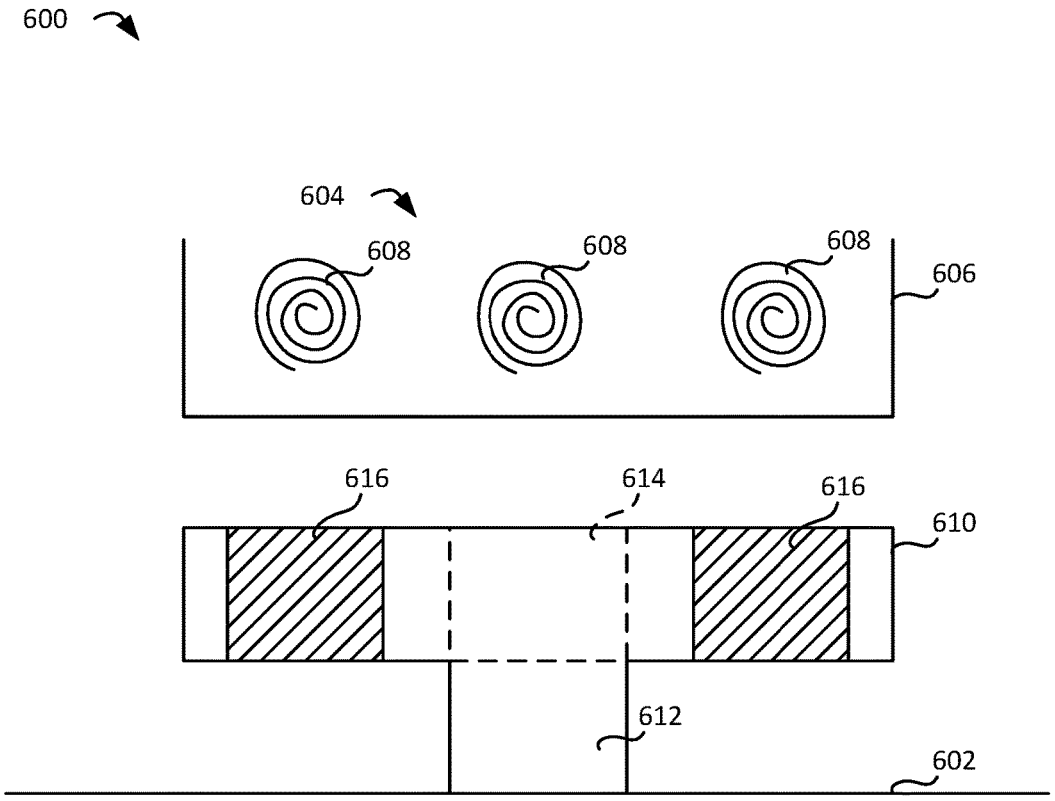
FIG. 11 shows an example implementation of a sensor device configured to determine the presence or absence of a removable component of a person support apparatus according to one or more embodiments shown or described herein.

FIG. 11 shows a schematic view of an example inductive sensor system 600 communicatively coupled to a component of a person support apparatus, such as a table top 602. In this particular implementation, for example, a sensor device 604, such as shown in FIG. 10, may be coupled to a bracket 606 or other connector of the person support apparatus and be configured to detect and/or identify one or more removable components of the person support apparatus configured to couple to the bracket 606 or other connector of the person support apparatus. In this example, the sensor device 604 comprises three inductive coil sensor elements 608 disposed on or adjacent to a surface of a bracket 606 of the person support apparatus. The bracket 606 is adapted to support a connector 610, such as a T-shaped tube 610 as shown in FIG. 11, of the removable component that snaps into the bracket or otherwise couples the removable component to the person support apparatus. The connector 610 of the removable component may, for example, be formed out of steel or another conductive material 612 that affects the inductive coil sensors 608 of the sensor device 604 in a first manner when placed in close proximity to a first conductive region 614. Portions of the connector 610 may also be treated to form one or more second non-conductive region 616 by applying a non-conductive coating, tape, adhesive, layer, wrap or the like over one or more portions of the connector 610. The one or more second non-conductive region 616 is adapted to alter the inductance or other electrical or magnetic property of the sensor element (e.g., inductive coil and inductive sensor). In another implementation, a conductive material of the connector may be removed from the connector in one or more regions 616 corresponding to a sensor element (e.g., inductive coil) of a corresponding sensor device. In this particular implementation, the presence of the conductive material in a first region 614 may provide a first state detected by the sensor element and the absence of the conductive material may provide a second state in the second region(s) 616. Similarly, a portion of the conductive material of the connector 610 in one or more regions 616 may be removed and replaced with one or more non-conductive coating, tape, adhesive, layer, wrap or the like.

Figure 13:
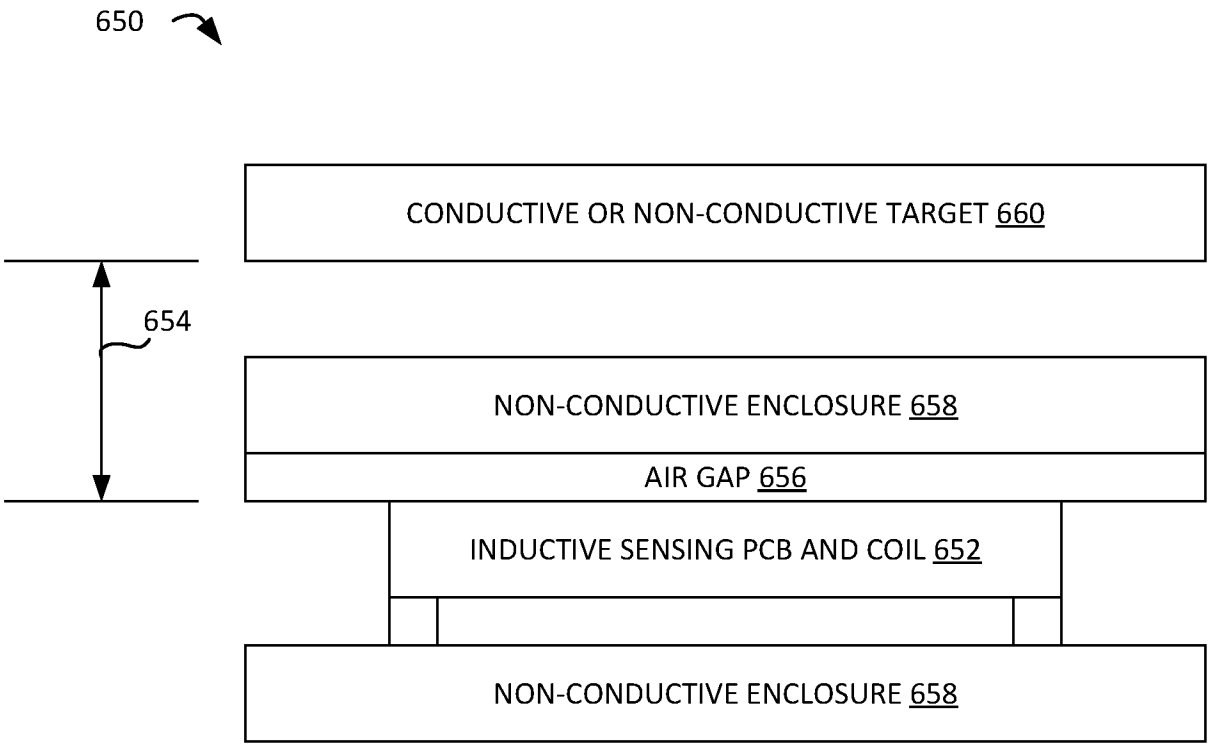
FIG. 13 schematically depicts an example implementation of an inductive coil sensing element according to one or more embodiments shown or described herein.

FIG. 13 schematically depicts one example implementation of an inductive coil sensing element 650 in which one or more inductive coils are disposed on an inductive sensing printed circuit board (PCB) 652. In this particular implementation, an inductive coil diameter size may be tuned for a particular application in order to set a switching distance 654 (proximity of the conductive material before the sensor registers a change in state). An inductive coil with a 20 mm diameter, for example, may provide approximately 7-7.5 mm switching distance in one example. The switching distance 654 in this example may be factored from a surface of the coil on the PCB 652, through any insulation air/plastics 656, 658, out to where a target 670, such as a connector or component surface (e.g., patient support table surface) is placed. In one particular implementation, for example, the switching distance 654 may be set at a point in which it can only be sensed if the target 660 removable component (e.g., table top) is mechanically secured/locked to the person support apparatus (e.g., a bracket of the person support apparatus). When adding up a total distance from PCB to the ideal switching point, it may be about 10 mm as an example.

In the example implementation shown in FIG. 11, for example, a T-shaped tube connector 610 is formed out of a conductive material 612 such as steel (e.g., stainless steel). In this particular example, two regions 616 of the connector opposite two corresponding sensor elements (e.g., inductive coils 608) comprise one or more non-conductive material (e.g., non-conductive coating, tape, adhesive, layer, wrap or the like). A third region 614 opposite a third corresponding sensor element 608 comprises a conductive material 612 (e.g., the steel of the connector). Thus, when the connector 610 is coupled to a bracket 606 on which the sensor elements 604 are disposed, the first and second conductive coils 608 of the first and second sensor elements provide a first signal level (e.g., inductance level) corresponding to a first state (corresponding to a non-conductive material detected on corresponding regions of the connector) and the third conductive coil 608 of the third sensor element provides a second signal level (e.g., inductance level) corresponding to a second state (corresponding to a conductive material detected on the corresponding region of the connector).

In one particular implementation, the first and second states corresponding to conductive 612 and non-conductive materials sensed near the sensor elements 604 (e.g., inductive coils 608) may represent a binary code or other code. The code, in turn, may be used to identify one or more of a plurality of different removable components of a person support apparatus. Thus, in the example shown in FIG. 11 in which three different inductive coil sensor elements 608 are disposed on a bracket 606 or other region of the person support apparatus, up to eight different removable components per sensor element 604 may be assigned different codes based on the materials used on the connector and identified by identifying the corresponding code (000, 001, 010, 011, 100, 101, 110, 111). Any number of components may be similarly identified by varying the number of sensor elements in a sensor device. Also, binary code is only one example of a code and other code types or identifiers are also contemplated. A near field communications (NFC) device may also be used to read component identifiers, such as passive or active tags or stickers. Further codes may be subject to encryption for security purposes.

Figure 12:
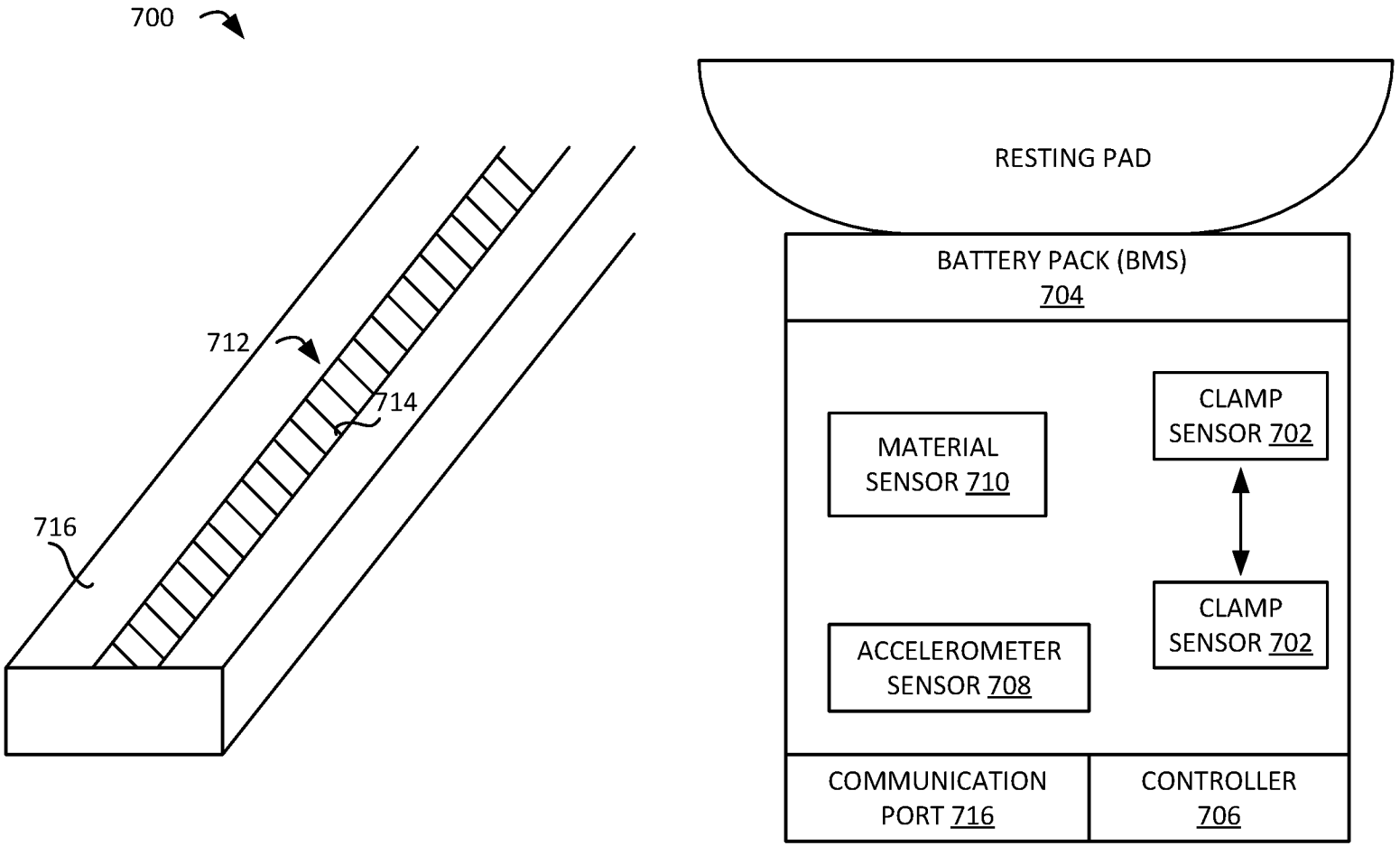
FIG. 12 schematically depicts yet another example implementation of a sensor device configured to determine the presence or absence of a removable component of a person support apparatus according to one or more embodiments shown or described herein.

FIG. 12 shows another implementation of a sensor device 700 configured to determine the presence or absence of a removable component, such as a pad or table top of a person support apparatus, as well as also detect additional information, such as but not limited to tilt, orientation, pressure mapping, temperature, patient movement, timing and the like. As shown in FIG. 12, for example, a first set of sensors connect when a clamp (e.g., holding the removable component to the person support apparatus) is fully engaged (e.g., clamped) into place and the removable component is secured to the person support apparatus. In one particular implementation, a battery management system (BMS) 704 and controller 706 (e.g., a microcontroller) are active, but in an energy efficient sleep state. When an accelerometer, proximity or other sensor 708 detects movement, it can alert the controller 706 and/or BMS 704 (e.g., via an interrupt state change) to wake up and look for sensor data. A material sensor 710, for example, is configured to detect an identifier 712 (e.g., a metallic region, such as a strip, shape, layer, coating or the like) disposed on the removable component. In an imaging application, for example, the identifier 712 may comprise a conductive identifier 714 disposed on a non-conductive (e.g., carbon fiber, polymer, plastic or the like) portion of the removable component that may be outside an imaging region so as to reduce the likelihood of interference with an imaging device. In this manner, the non-conductive region of the component may be disposed within an imaging region and the conductive region corresponding to the identifier may be disposed outside of a likely imaging region in use so as to reduce the likelihood of interfering with the imaging device. In other implementations, for example, other identifiers may include non-conductive materials, combinations of conductive and non-conductive materials, color (e.g., unique color identifiers), light reflection and/or proximity, magnetic identifiers (e.g., a reed or Hall Effect switch) or the like. A communication port 716 (e.g., a wireless port such as a Bluetooth port or a wired port such as an USB port) may also be used to provide communications between the sensor device 700 and another system.

It should now be understood that systems and processes of controlling a movement or function of a person support apparatus are provided. In one embodiment, for example, a system includes a person support apparatus adapted to support a patient. The person support apparatus comprising a controller adapted to communicatively couple with at least one removable component of the person support apparatus. The controller is adapted to determine the absence or presence of the at least one removable component. In response to the determination, the controller is further adapted to disable at least one movement of the person support apparatus in response to a determination that the at least one removable component is not present or enable the at least one movement in response to a determination that the at least one removable component is present. In another embodiment, a process of enabling or disabling at least one movement of a person support apparatus is provided. In this embodiment, the process includes: using a processor adapted to communicate with at least one removable component of a person support apparatus; determining the presence or absence of the at least one removable component of the person support apparatus; in response to a determination that the at least one removable component is not present, disabling at least one movement of the person support apparatus or in response to a determination that the at least one removable component is present enabling the at least one movement.

It will be apparent to those skilled in the art that various modifications and variations can be made to the embodiments described herein without departing from the spirit and scope of the claimed subject matter. Thus it is intended that the specification cover the modifications and variations of the various embodiments described herein provided such modification and variations come within the scope of the appended claims and their equivalents.

What is claimed is:

1. A system of controlling a function of a person support apparatus, the system comprising:

a person support apparatus adapted to support a patient, the person support apparatus comprising a controller adapted to communicatively couple with at least one removable component of the person support apparatus, the controller adapted to determine the absence or presence of the at least one removable component and in response to the determination disable or enable at least one movement of the person support apparatus in response to a determination that the at least one removable component is present or absent.

2. The system of claim 1 wherein the controller is adapted to wirelessly communicate with the at least one removable component.

3. The system of claim 2 wherein the controller is adapted to wirelessly communicate with the at least one removable component via one or more of the group comprising: radio frequency, Bluetooth, infrared and WiFi.

4. The system of claim 1 wherein the controller is adapted to communicate with the at least one removable component via a wired communication.

5. The system of claim 4 wherein the controller is adapted to communicate with the at least one removable component via one or more of the group comprising: USB, Firewire, and lightning communications.

6. The system of claim 1 wherein the at least one removable component comprises a safety component.

7. The system of claim 1 wherein person support apparatus comprises an operating table.

8. The system of claim 1 wherein at least one movement comprises at least one of a rotation and a tilt.

9. The system of claim 1 wherein the at least one removable component comprises an identifier.

10. The system of claim 9 wherein the at least one removable component comprises a transmitter for transmitting the identifier to the controller.

11. The system of claim 9 wherein the identifier comprises an RFID.

12. The system of claim 1 wherein the controller is adapted to determine the presence or absence of the at least one removable component via at least one inductive coil sensor.

13. A process of enabling or disabling at least one movement of a person support apparatus, the process comprising:

using a processor adapted to communicate with at least one removable component of a person support apparatus;

determining the presence or absence of the at least one removable component of the person support apparatus;

in response to a determination that the at least one removable component is present or absent, disabling or enabling at least one movement of the person support apparatus.

14. The process of claim 13 wherein the controller is adapted to wirelessly communicate with the at least one removable component.

15. The process of claim 14 wherein the controller is adapted to wirelessly communicate with the at least one removable component via one or more of the group comprising: radio frequency, Bluetooth, infrared and WiFi.

16. The process of claim 13 wherein the controller is adapted to communicate with the at least one removable component via a wired communication.

17. The process of claim 16 wherein the controller is adapted to communicate with the at least one removable component via one or more of the group comprising: USB, Firewire, and lightning communications.

18. The process of claim 13 wherein the at least one removable component comprises a safety component.

19. The process of claim 13 wherein person support apparatus comprises an operating table.

20. The process of claim 13 wherein at least one movement comprises at least one of a rotation and a tilt.

21. The process of claim 13 wherein the at least one removable component comprises an identifier.

22. The process of claim 21 wherein the at least one removable component comprises a transmitter for transmitting the identifier to the controller.

23. The process of claim 21 wherein the identifier comprises an RFID.

24. The process of claim 13 wherein the controller is adapted to determine the presence or absence of the at least one removable component via at least one inductive coil sensor.

* * * * *